US006899771B2

(12) United States Patent
Kami et al.

(10) Patent No.: US 6,899,771 B2
(45) **Date of Patent: *May 31, 2005**

(54) HIGH TENSILE STRENGTH COLD ROLLED STEEL SHEET HAVING EXCELLENT STRAIN AGE HARDENING CHARACTERISTICS AND THE PRODUCTION THEREOF

(75) Inventors: Chikara Kami, Chiba (JP); Akio Tosaka, Chiba (JP); Kazunori Osawa, Kurashiki (JP); Shinjiro Kaneko, Chiba (JP); Takuya Yamazaki, Chiba (JP); Kaneharu Okuda, Chiba (JP); Takashi Ishikawa, Chiba (JP)

(73) Assignee: JFE Steel Corporation (JP)

( * ) Notice: Subject to any disclaimer, the term of this patent is extended or adjusted under 35 U.S.C. 154(b) by 133 days.

This patent is subject to a terminal disclaimer.

(21) Appl. No.: 10/341,165

(22) Filed: Jan. 13, 2003

(65) Prior Publication Data

US 2003/0188811 A1 Oct. 9, 2003

Related U.S. Application Data

(62) Division of application No. 09/980,513, filed as application No. PCT/JP01/01003 on Feb. 14, 2001, now Pat. No. 6,702,904.

(30) Foreign Application Priority Data

| | | |
|---|---|---|
| Feb. 29, 2000 | (JP) | 2000-053923 |
| May 31, 2000 | (JP) | 2000-162497 |
| May 23, 2000 | (JP) | 2000-151170 |

(51) Int. Cl.[7] ..... C22C 38/06; C22C 38/12; C21D 8/02

(52) U.S. Cl. ..... 148/320; 148/603; 148/652

(58) Field of Search ..... 148/320, 330, 148/603, 652, 602

(56) References Cited

U.S. PATENT DOCUMENTS

| | | | |
|---|---|---|---|
| 3,673,009 A | 6/1972 | Levy | |
| 5,123,969 A | 6/1992 | Tung-Sheng | |
| 6,695,932 B2 * | 2/2004 | Kami et al. | 148/320 |

FOREIGN PATENT DOCUMENTS

| | | |
|---|---|---|
| EP | 0 429 094 A | 5/1991 |
| EP | 0 608 430 A | 8/1994 |
| EP | 0943696 | 9/1999 |
| EP | 0 999 288 A | 5/2000 |
| JP | 58 003922 A | 3/1983 |
| JP | 60 052528 A | 7/1985 |
| JP | 60 145355 A | 12/1985 |
| JP | 61272323 | 12/1986 |
| JP | 04074824 | 3/1992 |
| JP | 6-116682 | 4/1994 |
| JP | 0 612 857 A | 8/1994 |
| JP | 07 090482 A | 8/1995 |
| JP | 8-35039 | 2/1996 |
| JP | 08 035039 A | 6/1996 |
| JP | 08 325670 A | 4/1997 |
| JP | 9-296252 | 11/1997 |
| JP | 11-80919 | 3/1999 |
| JP | 55 141526 A | 1/2001 |

* cited by examiner

*Primary Examiner*—Deborah Yee
(74) *Attorney, Agent, or Firm*—DLA Piper Rudnick Gray Cary US LLP

(57) ABSTRACT

The present invention presents a high tensile strength cold rolled steel sheet having excellent formability, impact resistance and strain age hardening characteristics, and the production thereof. As a specific means, a slab having a composition which contains, by mass %, 0.15% or less of C, 0.02% or less of Al, and 0.0050 to 0.0250% of N at N/Al of 0.3 or higher, and has N in a solid solution state at 0.0010% or more, is first hot rolled at the finish rolling delivery-side temperature of 800° C. or above, and is subsequently coiled at the coiling temperature of 750° C. or below to prepare a hot rolled plate. Then, after cold rolling, the hot rolled plate is continuously cooled at a temperature from the recrystallization temperature to 900° C. at a holding time of 10 to 120 seconds, and is cooled by primary cooling in which the hot rolled plate is cooled to 500° C. or below at a cooling rate of 10 to 300° C./s, and furthermore if necessary, by secondary cooling in which a residence time is 300 seconds or less in a temperature range of the primary cooling stopping temperature or below and 350° C. or higher. Provided is a steel sheet containing a ferritic phase having an average crystal grain size of 10 $\mu$m or less at an area ratio of 50% or more, and if necessary, a martensitic phase at an area ratio of 3% or more as a second phase.

3 Claims, No Drawings

HIGH TENSILE STRENGTH COLD ROLLED STEEL SHEET HAVING EXCELLENT STRAIN AGE HARDENING CHARACTERISTICS AND THE PRODUCTION THEREOF

TECHNICAL FIELD

The present invention relates to a high tensile strength cold rolled steel sheet which is mainly useful for vehicle bodies, and particularly, relates to a high tensile strength cold rolled steel sheet having tensile strength (TS) of 440 MPa or higher and excellent strain age hardening characteristics, and the production thereof. The high tensile strength cold rolled steel sheet of the present invention is widely applicable, ranging from relatively light working, such as forming into a pipe by light bending and roll forming, to relatively heavy drawing. Moreover, the steel sheet of the present invention includes a steel strip.

"Having excellent strain age hardening characteristics" in the present invention indicates that an increase in deformation stress before and after an aging treatment (referred to as BH amount; BH amount=yield stress after the aging treatment−predeformation stress before the aging treatment) is 80 MPa or higher under the aging condition of holding the temperature at 170° C. for 20 minutes after the predeformation at the tensile strain of 5%, and that an increase in tensile strength (mentioned as ΔTS; ΔTS=tensile strength after the aging treatment−tensile strength before the predeformation) before and after a strain aging treatment (the predeformation+the aging treatment) is 40 MPa or higher.

BACKGROUND ART

The reduction of vehicle body weights has been a critical issue, which relates to the regulation of emission gas and recent global environmental problems. In order to lighten the body of a vehicle, it is effective to reduce the thickness of steel sheets by increasing the strength of steel sheets that are used in quantity, in other words, by using high tensile strength steel sheets.

However, even vehicle parts of thin high tensile strength steel sheets have to perform sufficiently well based on their purposes. The performance includes, for instance, static strength against bending and torsional deformation, fatigue resistance impact resistance, and the like. Therefore, high tensile strength steel sheets for use in vehicle parts also have to have such excellent characteristics after being formed.

Moreover, press forming is carried out on steel sheets to form vehicle parts. However, when the steel sheets are too strong, the following problems are found:

(1) shape freezability declines; and (2) problems such as cracking and necking are found during forming due to a decrease in ductility. The application of high tensile strength steel sheets to vehicle bodies has been limited.

In order to overcome this problem, steel sheets that use an extra-low carbon steel as a material and in which the amount of C finally remaining in a solid solution state is controlled in an appropriate range are known as, for instance, cold rolled steel sheets for an outer sheet panel. This type of steel sheet is kept soft during press forming, and maintains shape freezability and ductility and maintains dent resistance due to an increase in yield stress which utilized strain age hardening phenomenon during the coating and baking process of 170° C.×about 20 minutes after press forming. In this type of steel sheet, C is dissolved in steel in a solid solution state during press forming, and the steel is soft. On the other hand, after press forming, solid solution C is fixed to a dislocation that is introduced during the press forming, in the coating and baking process, thus increasing yield stress.

However, an increase in yield stress due to strain age hardening is kept low in this type of steel sheet in order to prevent stretcher strains that will later become surface defects. Thus, there is little contribution to the actual weight reduction of parts.

Specifically, not only does yield stress have to be -increased by strain aging but strength characteristics also have to increase so as to reduce the weight of parts. In other words, it is desirable to make parts stronger by increasing tensile strength after strain aging.

For applications in which appearance is not so much of a concern, proposed are steel sheets in which a baking hardening quantity is further increased by using solid solution N, and steel sheets which have a composite structure consisting of ferrite and martensite and thus have improved baking hardenability.

For instance, Japanese Unexamined Patent Application Publication No. 60-52528 discloses a production of high-strength thin steel having good ductility and spot weldability in which steel containing 0.02 to 0.15% of C, 0.8 to 3.5% of Mn, 0.02 to 0.15% of P, 0.10% or less of Al, and 0.005 to 0.025% of N is coiled at 550° C. or below for hot-rolling, and annealing after cool-rolling is a controlled cooling heat treatment. The steel sheet produced in the art of Japanese Unexamined Patent Application Publication No. 60-52528 has a mixed structure consisting of a low-temperature transformation product phase mainly having ferrite and martensite, and has excellent ductility. At the same time, high strength is obtained by utilizing strain aging during a coating and baking process due to N, which is actively added.

However, in the art of Japanese Unexamined Patent Application Publication No. 60-52528, an increase in yield stress YS due to strain age hardening is large, but an increase in tensile strength TS is small. Moreover, the fluctuation of mechanical properties is large, so that an increase in yield stress YS is large and uneven. Thus, it is not currently possible to expect a steel sheet that is thin enough to contribute the weight reduction of vehicle parts.

Moreover, Japanese Examined Patent Application Publication No. 5-24979 discloses a cold rolled high tensile steel sheet having baking hardenability. The steel sheet contains 0.08 to 0.20% of C and 1.5 to 3.5% of Mn, and the balance Fe and inevitable, impurities as components. The steel structure is composed of uniform bainite containing 5% or less of ferrite, or bainite partly containing martensite. In the cold rolled steel sheet described in Japanese Examined Patent Application Publication No. 5-24979, a baking hardening quantity, as a structure mainly having bainite, is greater than conventionally used due to quenching in the temperature range of 400 to 200° C. and the following slow cooling in a cooling process after continuous annealing.

However, although a baking hardening quantity is greater than conventionally used due to an increase in yield strength after coating and baking in the cold rolled steel sheet described in Japanese Examined Patent Application Publication No. 5-24979, tensile strength cannot be increased. When the steel sheet is used for strong members, the improvement of fatigue resistance and impact resistance cannot be expected. Thus, there still is a problem in that the steel sheet cannot be used for applications that strongly require fatigue resistance, impact resistance, and the like.

Although it is a hot rolled steel sheet, proposed is a steel sheet having higher yield stress as well as yield strength due to a heat treatment after press forming.

For instance, Japanese Examined Patent Application Publication No. 8-23048 proposes a production of hot rolled steel plate having a composite structure mainly of ferrite and martensite in which steel containing 0.02 to 0.13% of C, 2.0% or less of Si, 0.6 to 2.5% of Mn, 0.10% or less of sol. Al, and 0.0080 to 0.0250% of N is reheated at 1,100° C. or higher and finish-rolling is finished at 850 to 900° C. for hot-rolling. Then, the steel is cooled to less than 150° C. at the cooling rate of 15° C./s or higher, and is coiled. However, although yield stress as well as tensile strength increase due to strain age hardening in the steel sheet produced in the art described in Japanese Examined Patent Application Publication No. 8-23048, steel is coiled at an extremely low coiling temperature of less than 150° C. Thus, the inconsistency of mechanical characteristics is large and troublesome. There also have been problems in that increases in yield stress after a press forming-coating and baking treatment are uneven, and furthermore, a hole expanding ratio (λ) is low, so that stretch-flanging workability declines and press forming becomes insufficient.

High tensile strength steel sheets having relatively high yield stress include so-called precipitation strengthened steel to which carbonitride-forming elements, such as Ti, Nb and V, are added and which is strengthened by the fine deposits thereof. However, unlike hot rolled steel sheets that go through a sufficient thermal insulation process after hot rolling, it is difficult for cold rolled steel sheets to obtain enough precipitation in a short period of continuous annealing. It has been difficult to produce a steel sheet having high yield ratios (ratios of yield stress relative to tensile strength:, YS/TS). Particularly, when C is reduced for weldability, it becomes more difficult to have high yield ratios, probably because the amount of deposit itself decreases in a region where the amount of C is low, and this is troublesome.

Furthermore, although the above-mentioned steel sheets show excellent strength after a coating and baking treatment in a simple tensile test, strengths are largely uneven when plastic deformation is carried out under actual press conditions. The steel sheets are not sufficiently applicable for parts that need to be reliable.

It is an object of the present invention to break through the limitations of the conventional arts mentioned above, and to provide a high tensile strength cold rolled steel sheet having excellent strain age hardening characteristics, high formability and stable quality and thus can obtain sufficient strength after being formed into vehicle parts, fully contributing to the reduction of vehicle body weights, and the production thereof that can economically produce the steel sheets without distorting the shapes thereof The strain age hardening characteristics in the present invention target 80 MPa or more of BH amounts and 40 MPa or more of ΔTS under the aging condition of holding the temperature at 170° C. for 20 minutes after predeformation at 5% of tensile strain.

Furthermore, the steel sheet is also advantageously applicable to, particularly, parts to which relatively small strain is added. Thus, it is also an object of the present invention to provide a high tensile strength cold rolled steel sheet having high yield ratios of 0.7 or higher so as to raise sheet yield stress and stabilize the strength of parts.

DISCLOSURE OF INVENTION

The present inventors, in order to achieve the objects mentioned above, produced steel sheets by changing compositions and conditions, and carried out many material evaluations. Accordingly, it was found that both the improvement of formability and an increase in strength after forming can be easily achieved by effectively utilizing a large strain age hardening phenomenon due to a strengthening element N, which has never much been conventionally actively used.

Furthermore, the present inventors realized that it is necessary to advantageously combine strain age hardening phenomenon due to N and coating and baking conditions of vehicles, or furthermore, heat treatment conditions after forming actively, and that it is effective to control the microstructure of steel sheets and solid solution N in certain ranges under appropriate hot rolling conditions and cold rolling, cold rolling annealing conditions therefor. They also found that it is important, with respect to composition, to control particularly an Al content in response to a N content in order to provide stable strain age hardening phenomenon due to N. Moreover, the present inventors realized that N can be sufficiently used without causing a conventional problem such as room temperature aging deterioration when the microstructure of steel sheets is composed of ferrite as a main phase and has an average grain size of 10 μm or less.

Furthermore, the present inventors found that low yield ratios are obtained and ductility and formability improve when the microstructure of steel sheets is composed of ferrite as a main phase and contains a martensite as a second phase at the area ratio of 3% or higher. At the same time, strain age hardening phenomenon due to N can be effectively utilized, increasing strength after forming and improving impact resistance as parts.

In other words, the present inventors found that a steel sheet having far superior formability than conventional solid solution strengthen type C Mn steel sheets and precipitation strengthening type steel sheets, and strain age hardening characteristics that are not found in the conventional steel sheets mentioned above, is provided when N is used as a strengthening element and an Al content is controlled in an appropriate range in response to a N content; at the same time, an appropriate microstructure and solid solution N are provided under the optimum hot rolling conditions and cold rolling, cold rolling annealing conditions.

Furthermore, the present inventors found that a steel sheet having far superior formability than conventional solid solution strengthening type C—Mn steel sheets and precipitation strengthening type steel sheets, high yield ratios of 0.7 or higher, and strain age hardening characteristics that are not found in the conventional steel sheets mentioned above, is provided when N is used as a strengthening element and an Al content is controlled at an appropriate range in response to a N content; at the same time, an appropriate microstructure, solid solution N (N in a solid solution state), and a Nb deposit (deposited Nb) are provided under the optimum hot rolling conditions and cold rolling, cold rolling annealing conditions.

The main phase is ferrite, and the residual portion is mainly pearlite. However, bainite or martensite at the area ratio of 2% or less is accentahle Morever, in order to increase the precipitation of the ferritic phase, it is preferable that the Nb deposit analyzed by a method mentioned later is 0.005% or more.

Moreover, the steel sheet of the present invention has higher strength after a coating and baking treatment in a simple tensile test than conventional steel sheets. Furthermore, the fluctuation of strengths is small when plastic deformation is carried out under actual pressing conditions, and the strength of parts is stable. For example, a part where thickness is reduced due to heavy strain is harder than other parts and tends to be even in the weighting load capacity of (sheet thickness)×(strength), and strength as parts become stable.

The present invention has been completed with further examinations based on the above-mentioned knowledge.

Specifically, a first invention is a high tensile strength cold rolled steel sheet having excellent strain age hardening characteristics with the tensile strength of 440 MPa or higher, and preferably, a sheet thickness of 3.2 mm or less. The steel sheet is characterized in that the sheet has a composition containing, by mass %, 0.15% or less of C, 2.0% or less of Si, 3.0% or less of Mn, 0.08% or less of P, 0.02% or less of S, 0.02% or less of Al, and 0.0050 to 0.0250% of N, having 0.3 or higher of N/Al and 0.0010% or more of N in a solid solution state, and having the balance of Fe and inevitable impurities. The steel sheet has a structure that contains a ferritic phase having an average crystal grain size of 10 $\mu$m or less at the area ratio of 50% or more. Moreover, it is preferable that the first invention further contains, in addition to the composition mentioned above, one group, or two or more groups of the following a to d by mass %:

Group a: one, or two or more elements of Cu, Ni, Cr, and Mo at the total of 1.0% or less;

Group b: one or two elements of Nb, Ti, and V at the total of 0.1% or less;

Group c: B at 0.0030% or less; and

Group d: one or two elements of Ca and REM at the total of 0.0010 to 0.010%.

Moreover, electroplating or melt plating may be carried out on the above-mentioned high tensile strength cold rolled steel sheet in the first invention.

A second invention is a production of a high tensile strength cold rolled steel sheet having excellent strain age hardening characteristics with the tensile strength of 440 MPa or more. The production is characterized in that sequentially carried out are: a hot rolling step in which a steel slab having a composition containing, by mass %, of 0.15% or less of C, 2.0% or less of Si, 3.0% or less of Mn, 0.08% or less of P, 0.02% or less of S. 0.02% or less of Al, and 0.0050 to 0.0250% of N, and having N/Al of 0.3 or higher is heated at the slab heating temperature of 1,000° C. or higher and is roughly rolled to form a sheet bar, and the sheet bar is finish rolled at the finish rolling deliver-side temperature of 800° C. or higher and is quenched at the cooling rate of 40° C./s or above, preferably, within 0.5 seconds after finish rolling and is coiled at the coiling temperature of 650° C. or below to form a hot rolled sheet; a cold rolling step in which the hot rolled sheet is pickled and cold rolled to form a cold rolled sheet; and a cold rolled sheet annealing step of primary cooling in which the cold rolled sheet is annealed at a temperature between the recrystallization temperature and 900° C. for the holding time of 10 to 60 seconds, and is cooled at the cooling rate of 10 to 300° C./s to the temperature of 500° C. or below, and a secondary cooling at the residence time of 300 seconds or less in a temperature range between the stopping temperature of the primary cooling and 400° C. It is preferable in the second invention that temper rolling or leveling at the elongation percentage of 1.0 to 15% is further carried out after the cold rolled sheet annealing step.

It is preferable in the second invention that adjacent sheet bars are joined between the rough rolling and the finish rolling. It is also preferable in the second invention that one or both of a sheet bar edge heater that heats a width edge section of the sheet bar, and a sheet bar heater that heats a length edge section of the sheet bar, are used between the rough rolling and the finish rolling.

A third invention is a high yield ratio type high tensile strength cold rolled steel sheet having excellent strain age hardening characteristics with the tensile strength of 440 MPa or higher and the yield ratio of 0.7 or above, and preferably, a sheet thickness of 3.2 mm or less. The steel sheet is characterized in that the sheet has a composition containing, by mass %, 0.15% or less of C, 2.0% or less of Si, 3.0% or less of Mn, 0.08% or less of P, 0.02% or less of S, 0.02% or less of Al, 0.0050 to 0.0250% of N, and 0.007 to 0.04% of Nb, having 0.3 or higher of N/Al and 0.0010% or more of N in a solid solution state, and having the balance of Fe and inevitable impurities. The steel sheet has a structure that contains a ferritic phase having an average crystal grain size of 10 $\mu$m or less at the area ratio of 50% or more, with mainly pearlite as a residual portion. Moreover, it is preferable that the third invention further contains, in addition to the composition mentioned above, one group, or two or more groups of the following a to d by mass %:

Group a: one, or two or more elements of Cu, Ni, Cr, and Mo at the total of 1.0% or less;

Group b: one or two elements of Ti and V at the total of 0.1% or less;

Group c: B at 0.0030% or less; and

Group d: one or two elements of Ca and REM at the total of 0.0010 to 0.010%.

A fourth invention is a production of a high tensile strength cold rolled steel sheet having excellent strain age hardening characteristics with the tensile strength of 440 MPa or more and the yield ratio of 0.7 or above. The production is characterized in that sequentially carried out are: a hot rolling step in which a steel slab having a composition containing, by mass %, 0.15% or less of C, 2.0% or less of Si, 3.0% or less of Mn, 0.08% or less of P, 0.02% or less of S, 0.02% or less of Al, 0.0050 to 0.0250% of N, and 0.007 to 0.04% of Nb, and having N/Al of 0.3 or higher is heated at the slab heating temperature of 1,100° C. or higher and is roughly rolled to form a sheet bar, and the sheet bar is finish rolled at the final pass draft of 25% or more at the finish rolling delivery-side temperature of 800° C. or higher and is quenched at the cooling rate of 40° C./s or above, preferably, within 0.5 seconds after finish rolling and is coiled at the coiling temperature of 650° C. or below to form a hot rolled sheet; a cold rolling step in which the hot rolled sheet is pickled and cold rolled to form a cold rolled sheet; and a cold rolled sheet annealing step in which the cold rolled sheet is annealed at a temperature between the recrystallization temperature and 900° C. for the holding time of 10 to 60 seconds and is cooled at the cooling rate of 70° C./s or below to the temperature range of 600° C. and below. It is preferable in the fourth invention that temper rolling or leveling at the elongation percentage of 1.5 to 15% is further carried out after the cold rolled sheet annealing step.

It is preferable in the fourth invention that adjacent sheet bars are joined between the rough rolling and finish rolling. It is also preferable in the fourth invention that one or both of a sheet bar edge heater that heats a width edge section of the sheet bar, and a sheet bar heater that heats a length edge section of the sheet bar, are used between the rough rolling and the finish rolling.

A fifth invention is a high tensile strength cold rolled steel sheet having excellent strain age hardening characteristics, formability and impact resistance, tensile strength of 440 MPa or higher and, preferably, a sheet thickness of 3.2 mm or less. The steel sheet is characterized in that the sheet has a composition containing, by mass %, 0.15% or less of C, 3.0% or less of Mn, 0.02% or less of S, 0.02% or less of Al, and 0.0050 to 0.0250% of N, and furthermore, one or two elements of Mo at 0.05 tb 1.0% and Cr at 0.05 to 1.0%, having 0.3 or higher of N/Al and 0.0010% or more of N in a solid solution state, and having the balance of Fe and inevitable impurities. The steel sheet has a structure that contains a ferritic phase having an average crystal grain size of 10 μm or less at the area ratio of 50% or more, and furthermore, a martensitic phase at the area ratio of 3% or more. Moreover, it is preferable that the fifth invention further contains, in addition to the composition mentioned above, one group, or two or more groups of the following e to h by mass %:

Group e: one, or two or more elements of Si at 0.05 to 1.5%, P at 0.03 to 0.15%, and B at 0.0003 to 0.01%;

Group f: one, or two or more elements of Nb at 0.01 to 0.1%, Ti at 0.01 to 0.2%, and V at 0.01 to 0.2%;

Group g: one or two elements of Cu at 0.05 to 1.5% and Ni at 0.05 to 1.5%; and

Group h: one or two elements of Ca and REM at the total of 0.0010 to 0.010%.

Moreover, a sixth invention is a production of a high tensile strength cold rolled steel sheet having excellent strain age hardening characteristics, formability and impact resistance and tensile strength of 440 MPa or more. The production is characterized in that sequentially carried out are: a hot rolling step in which a steel slab having a composition containing, by mass %, 0.15% or less of C, 3.0% or less of Mn, 0.02% or less of S, 0.02% or less of Al, and 0.0050 to 0.0250% of N, and furthermore, one or two elements of Mo at 0.05 to 1.0% and Cr at 0.05 to 1.0%, having N/Al of 0.3 or higher, or furthermore, containing one group, or two or more groups of the following e to h:

Group e: one, or two or more elements of Si at 0.05 to 1.5%, P at 0.03 to 0.15%, and B at 0.0003 to 0.01%;

Group f: one, or two or more elements of Nb at 0.01 to 0.1%, Ti at 0.01 to 0.2%, and V at 0.01 to 0.2%;

Group g: one or two elements of Cu at 0.05 to 1.5% and Ni at 0.05 to 1.5%; and

Group h: one or two elements of Ca and REM at the total of 0.0010 to 0.010% is heated at the slab heating temperature of 1,000° C. or above and is roughly rolled to form a sheet bar, and the sheet bar is finish rolled at the finish rolling delivery-side temperature of 800° C. or above and is coiled at the coiling temperature of 750° C. or below to form a hot rolled sheet; a cold rolling step in which the hot rolled sheet is pickled and cold rolled to form a cold rolled sheet, and a cold rolled sheet annealing step in which the cold rolled sheet is annealed at the temperature between (Ac, transformation point) and ($AC_3$ transformation point) for the holding time of 10 to 120 seconds and is cooled at the average cooling rate of a critical cooling rate CR or higher from 600 to 300° C. The critical cooling rate CR is defined by the following formula (1) or (2):

$$\text{when } B<0.0003\%,\ \log CR=-1.73[\mathrm{Mn}+2.67\mathrm{Mo}+1.3\mathrm{Cr}+0.26\mathrm{Si}+3.5\mathrm{P}+0.05\mathrm{Cu}+0.05\mathrm{Ni}]+3.95 \quad (1);\ \text{and}$$

$$\text{when } B\geqq 0.0003\%,\ \log CR=-1.73[\mathrm{Mn}+2.67\mathrm{Mo}+1.3\mathrm{Cr}+0.26\mathrm{Si}+3.5\mathrm{P}+0.05\mathrm{Cu}+0.05\mathrm{Ni}]+3.40 \quad (2)$$

wherein CR is a cooling rate (° C./s); and Mn, Mo, Cr, Si, P, Cu and Ni are contents of each element (mass %). It is preferable in the sixth invention that the cooling is started within 0.5 seconds after the finish rolling, and quenching is performed at the cooling rate of 40° C./s or above before the coiling. It is also preferable in the sixth invention that temper rolling or leveling at the elongation percentage of 1.0 to 15% is further carried out after the cold rolled sheet annealing step.

BEST MODE FOR CARRYING OUT THE INVENTION

First, the reasons for limiting the composition of the steel sheet of the present invention will be explained. Mass % is simply noted as % hereinafter.

C: 0.15% or below

C is an element that increases the strength of a steel sheet. Moreover, in order to achieve important features of the present invention such as the average grain size of ferrite at 10 μm or less, and furthermore, to maintain desirable strength, it is preferable to contain C at 0.005% or more. However, beyond 0.15%, a fractional ratio of carbide becomes excessive in a steel sheet, thus clearly lowering ductility and deteriorating formability. Furthermore, spot weldability, arc weldability, and the like clearly decline. In consideration of formability and weldability, the content of C is limited to 0.15% or less, or preferably, 0.10% or less. For applications requiring more preferable ductility, C is contained preferably at 0.08% or less. For applications requiring the most preferable ductility, C is contained preferably at 0.05% or less.

Si: 2.0% or less

Si is a useful element for strengthening a steel sheet without clearly reducing the ductility of steel, and is preferably contained at 0.1% or more. On the other hand, Si sharply increases a transformation point during hot rolling, deteriorating quality and shape or providing negative effects on the appearance of a steel sheet surface, such as surface properties and chemical convertibility. In the present invention, the content of Si is limited to 2.0% or less. When Si is contained at 2.0% or less, the sharp increase of a transformation point can be prevented by adjusting the amount of Mn added along with Si, and good surface properties can be kept. Moreover, it is preferable to contain Si at 0.3% or more in a high tensile strength steel sheet having the tensile strength TS of more than 500 MPa for a balance between strength and ductility.

Mn: 3.0% or less

Mn is a useful element, preventing S from causing thermal cracking, and is preferably added in response to S content. Moreover, Mn is effective in the refinement of crystal grains as an important feature of the present invention. It is preferable to actively add Mn to improve the quality of a material. Moreover, Mn is an element, improving hardenability. It is preferable to actively add Mn to form a martensitic phase as a second phase with stability. Mn is preferably contained at 0.2% or more for fixing S with stability and forming a martensitic phase.

Moreover, Mn is an element increasing steel sheet strength, and is preferably contained at 1.2% or more for providing strength of more than TS 500 MPa. It is more preferable to contain Mn at 1.5% or more to maintain strength with stability. When a Mn content is increased to this level, fluctuations of mechanical properties and strain age hardening characteristics of a steel sheet in relation to the change in production conditions, including hot rolling conditions, become small, thus effectively stabilizing quality.

Mn also lowers a transformation point during a hot rolling process. As Mn is added with Si, it can prevent Si from increasing a transformation point. Particularly, in products having thin sheet thickness, since quality and shape sensitively change due to the fluctuation of transformation points, it is important to strictly balance the contents of Mn and Si. Accordingly, it is more preferable that Mn/Si is 3.0 or higher.

On the other hand, when Mn is contained in a large amount of more than 3.0%, the thermal deformation resistance of a steel sheet tends to increase and spot weldability and the formability of a weld zone tend to deteriorate. Furthermore, as the generation of ferrite is restricted, ductility tends to clearly decline. Thus, the content of Mn is limited to 3.0% or less. Additionally, for applications requiring good corrosion resistance and formability, the content of Mn is preferably 2.5% or less. For applications requiring better corrosion resistance and formability, the content of Mn is 1.5% or less.

P: 0.08% or less

P is a useful element as a solid solution strengthening element for steel. However, when P is added excessively, steel becomes brittle, and furthermore, the stretch-flanging workability of a steel sheet declines. Moreover, P is likely to be segregated in steel, which makes a weld zone brittle thereby. Therefore, the content of P is limited to 0.08% or less. When stretch-flanging workability and weld zone toughness are particularly emphasized, it is preferable that P is contained at 0.04% or less, and more preferably, 0.02% or less for weld zone toughness.

S: 0.02% or less

S is an inclusion in a steel sheet, and is an element that deteriorates the ductility of a steel sheet and also corrosion resistance. In the present invention, the content of S is limited to 0.02% or less. For applications requiring particularly good formability, the content is preferably 0.015% or less. Furthermore, when stretch-flanging workability is highly required, the content of S is preferably 0.008% or less. Moreover, in order to maintain high strain age hardening characteristics with stability, the content of S is preferably reduced to 0.008% or less although the detailed mechanism thereof is unclear.

Al: 0.02% or less

Al is a useful element that functions as a deoxidizer and improves the purity of steel. Furthermore, Al is an element refining the structure of a steel sheet. In the present invention, Al is preferably contained at 0.001% or more. On the other hand, excessive Al deteriorates surface properties of a steel sheet, and furthermore, solid solution N as an important feature of the present invention is reduced. Thus, solid solution N contributing to strain age hardening phenomenon becomes insufficient, and strain age hardening characteristics are likely to be inconsistent when production conditions are changed. Accordingly, in the present invention, Al content is limited to a low 0.02% or less. In consideration of material stability, the content of Al is preferably 0.015% or less.

N: 0.0050 to 0.0250%

N is an element increasing the strength of a steel sheet due to solid solution strengthening and strain age hardening, and is the most important element in the present invention. N also lowers the transformation point of steel, and is also useful for stable operation under a situation of rolling thin sheets while heavily interrupting transformation points. By adding an appropriate amount of N and controlling production conditions, the present invention obtains solid solution N in a necessary and sufficient amount for cold rolled products and plated products. Accordingly, strength (YS, TS) in solid solution strengthening and strain age hardening sufficiently increases. The mechanical properties of the steel sheet of the present invention are satisfied with stability, including 440 MPa or above of TS, 80 MPa or above of a baking hardening amount (BH amount) and an increase in tensile strength before and after a strain aging process ΔTS of 40 MPa or above.

When the content of N is less than 0.0050%, an increase in strength is unlikely to be stable. On the other hand, when the content of N exceeds 0.0250%, a steel sheet tends to have more internal defects, and slab cracking and the like are likely to occur more frequently during continuous casting. Thus, the content of N is in the range of 0.0050 to 0.0250%. For the stability of quality and the improvement of yields in entire production processes, it is more preferable that the content of N is 0.0070 to 0.0170%. If the N content is within the range of the present invention, there are no negative effects on weldability of spot welding, arc welding, and the like.

N in a solid solution state: 0.0010% or more.

In order to obtain sufficient strength and furthermore provide enough strain age hardening due to N in cold rolled products, steel should have N in a solid solution state (also mentioned as solid state N) at an amount (in concentration) of 0.0010% or more.

The amount of solid solution N is calculated by subtracting a deposited N amount from a total N amount in steel. Based on the comparison of various analyses by the present inventors, it is effective to analyze a deposited N amount in accordance with an electrolytic extraction analysis applying a constant potential electrolysis. Methods of dissolving ferrite for extraction and analysis include acid decomposition, halogenation, and electrolysis. Among them, electrolysis can dissolve only ferrite with stability without decomposing unstable deposits such as carbide and nitride. Acetyl-acetone based electrolyte is used for electrolysis at a constant potential. In the present invention, a deposited N amount by the measurement of a constant potential electrolysis showed the best result in relation to the actual strength of parts.

Thus, after a residue is extracted by the constant potential electrolysis, a N content is found in the residue by chemical decomposition as a deposited N amount in the present invention.

In order to provide a high BH amount and ΔTS, the amount of solid solution N is 0.0020% or more. For a higher BH amount and ΔTS, it is preferable that the amount is 0.0030% or more. For a much higher BH amount and ΔTS, the amount of solid solution N is preferably 0.0050% or more.

N/Al (ratio between N content and Al content): 0.3 or higher.

In order to have residual solid solution N with stability at 0.0010% or more in a product, it is necessary to control the amount of Al as an element to firmly fix N. After examining steel sheets of various combination of N and Al contents within the composition range of the present invention, it was found that N/Al has to be 0.3 or higher to provide 0.0010% or more of solid solution N in a cold rolled product and a plated product when the amount of Al is limited low at 0.02% or below. In other words, the Al content is limited to (N content)/0.3 or less.

In the present invention, it is preferable to contain one group, or two or more groups of the following a to d in addition to the above-noted composition:

Group a: one, or two or more elements of Cu, Ni, Cr, and Mo at the total of 1.0% or less;

Group b: one or two elements of Nb, Ti and V at the total of 0.1% or less;

Group c: B at 0.0030% or less; and

Group d: one or two elements of Ca and REM at the total of 0.00010 to 0.010%.

The Group a elements of Cu, Ni, Cr and Mo contribute to an increase in strength of a steel sheet depending on needs, and they may be contained alone or in combination. However, when the content is too high, thermal deformation resistance increases or chemical convertibility and broad surface treatment characteristics deteriorate. Thus, a weld zone hardens, and weld zone formability deteriorates. Accordingly, it is preferable that the total content of the Group a is 1.0% or less.

The reason for containing one or both of Mo at 0.05 to 1.0% and Cr at 0.05 to 1.0%, in particular:

Both Mo and Cr contribute to an increase in strength of a steel sheet. Furthermore, the elements improve the hardenability of steel, and are likely to generate a martensitic phase as a second phase. In order to actively obtain a martensitic phase, the elements are contained alone or in combination. Particularly, Mo and Cr have a function to finely disperse a martensitic phase, and have effects to lower yield strength and easily achieve low yield ratios. Such effects are found when each amount of Mo and Cr is 0.05% or more. On the other hand, when Mo is contained at more than 1.0%, formability and surface treatment properties deteriorate. Thus, production costs increase, which is economically disadvantageous. Moreover, when the content of Cr is more than 1.0%, plating wettability deteriorates. Thus, the content of Mo is limited to 0.05 to 1.0%, and that of Cr is limited to 0.05 to 1.0%.

The Group b elements of Nb, Ti and V contribute to provide fine and uniform crystal grains. Depending on needs, the elements may be selected and contained alone or in combination. However, when the content is too large, thermal deformation resistance increases, and chemical convertibility and broad surface treatment characteristics deteriorate. Accordingly, it is preferable that the total content of the Group b is 0.1% or less. The reason for containing Nb at 0.007 to 0.04%, in particular:

In the present invention, Nb is an important element for visibly refining crystal grains, increasing YS and improving yield ratios (YR=YS/TS) at 0.7 or higher, and at the same time, achieving high strain age hardening due to N. In order to obtain these effects, the content of Nb is preferably 0.007% or more. On the other hand, in consideration of other nitride forming elements, Nb content is preferably limited to 0.04% or less to maintain a required amount of solid solution N.

Deposited Nb: 0.005% or more.

For the addition of Nb in the present invention, the existing state of Nb in steel is also important. In other words, it is preferable that Nb in a deposited state (also mentioned as deposited Nb) exists in a constant amount so as to obtain stable strain age hardening characteristics and 0.7 or above of yield ratios. Within the range of a Nb content of the present invention, deposited Nb content should be at least 0.005%. For the determination of Nb, Nb is dissolved by electrolytic extraction with the use of acetyl-acetone based solvent and is extracted. The value obtained by this method showed the best correlation with strain age hardening characteristics although there are various types of dissolution methods. It is assumed that Nb is more correlated to C than N within the range of the present invention, but the details thereof are unknown.

The Group c element of B is effective in improving the hardenability of steel. The element can be contained based on needs so as to increase a fractional ratio of a low temperature transformation phase, except for a ferritic phase, and to increase the strength of steel. However, when the content is too high, thermal deformation declines, and solid solution N decreases as BN is generated. Therefore, it is preferable that the content of B is 0.0030% or less.

The Group d elements of Ca and REM are useful for controlling the form of an inclusion. Particularly, when stretch-flanging formability is required, it is preferable to add the elements alone or in combination. In this case, when the total content of the Group d elements is less than 0.0010%, the effect of controlling a form is insufficient. On the other hand, when the content exceeds 0.010%, surface defects become apparent. Accordingly, it is preferable to limit the total content of the Group d to the range of 0.0010 to 0.010%.

Instead of the above-mentioned Group a to Group d, one, or two or more Groups of the following Group e to Group h may be added to the composition mentioned above in the present invention.

Group e: one, or two or more elements of Cu, Ni, Cr and Mo at the total of 1.0% or less;

Group f: one or two elements of Ti and V at the total of 0.1% or less;

Group g: B at 0.0030% or less; and

Group h: one or two elements of Ca and REM at the total of 0.0010 to 0.010%

The Group e elements of Cu, Ni, Cr and Mo contribute to an increase in strength without reducing high ductility of a steel sheet. This effect is found at 0.01% or above of Cu, 0.01% or above of Ni, 0.01% or above of Cr, and 0.01% or above of Mo. Based on needs, the elements may be selected and contained alone or in combination. However, when the content is too high, thermal deformation resistance increases, or chemical convertibility and broad surface treatment characteristics deteriorate. Thus, a weld zone hardens, and weld zone formability deteriorates. Accordingly, it is preferable that the total content of the Group e is 1.0% or less.

The Group f elements of Ti and V contribute to provide fine and uniform crystal grains. This effect is found at 0.002% or above for Ti and at 0.002% or above for V. Depending on needs, the elements may be selected and contained alone or in combination. However, when the content is too high, thermal deformation resistance increases, and chemical convertibility and broad surface treatment characteristics deteriorate. Thus, it is preferable that the Group b is contained at the total of 0.1% or less.

The Group g element of B is effective in improving the hardenability of steel. The element can be added based on needs so as to increase a fractional ratio of a low temperature transformation phase, except for a ferritic phase, and to increase the strength of steel. This effect is found when B is added at 0.0002% or more. However, when the amount is too large, thermal deformation deteriorates, and solid solution N decreases because of the generation of BN. Thus, it is preferable that B is 0.0030% or less.

The Group h elements of Ca and REM are useful for controlling the form of an inclusion. Particularly, when stretch-flanging formability is required, it is preferable to add the elements alone or in combination. In this case, when the total content of the Group h elements is less than 0.0010%, the effect of controlling a form is insufficient. On the other hand, when the content exceeds 0.010%, surface defects become apparent. Accordingly, it is preferable to limit the total content of the Group d to the range of 0.0010 to 0.010%.

Subsequently, the structure of a steel sheet of the present invention will be explained.

Area ratio of a ferritic phase: 50% or above.

The purpose of a cold rolled steel sheet of the present invention is an application for steel sheets for vehicles and the like that is preferably highly workable. In order to maintain ductility, the steel sheet has a structure containing a ferritic phase at an area ratio of 50% or above. When the area ratio of the ferritic phase is less than 50%, it is difficult to obtain required ductility as a steel sheet for vehicles that has to be highly workable. For greater ductility, the area ratio of the ferritic phase is preferably 75% or above. The ferrite of the present invention includes not only normal ferrite (polygonal ferrite) but also bainitic ferrite and acicular ferrite that contain no carbide.

Moreover, other phases, besides a ferritic phase, are not particularly limited. However, in order to increase strength, a single phase or a mixed phase of bainite and martensite is preferable. Additionally, in the component ranges and production method of the present invention, retained austenite is often formed at less than 3%.

In order to increase YS so as to improve yield ratios (YR=YS/TS) at 0.7 or higher and to have high strain age hardening due to N, it is desirable in the present invention that a phase (second phase), other than a ferritic phase, is a structure composed mainly of pearlite, in other words, a structure composed of a pearlistic single phase, or a structure that contains bainite or martensite at an area ratio of 2% or less with the balance pearlite.

On the other hand, the composition of the steel sheet of the present invention in which a martensitic phase is finely dispersed and yield strength is reduced to achieve low yield ratios, is a microstructure containing a ferritic phase as a main phase and a martesitic phase as a second phase. Additionally, when the area ratio of a ferritic phase exceeds 97%, effects as a composite structure cannot be expected.

Area ratio of a martensitic phase: 3% or above.

The martensitic phase as a second phase is dispersed mainly at the grain boundary of the ferritic phase as a main phase. Martensite is a hard phase, and increases the strength of a steel sheet by strengthening a structure. Furthermore, as moving dislocations are generated during transformation, martensite improves ductility and lowers yield ratios of a steel sheet. These effects become clear when martensite exists at 3% or more. When martensite exceeds 30%, a problem such as a decrease in ductility is found. Thus, the area ratio of martensite as a second phase is between 3% and 30%, preferably, 20% or less. Moreover, no problems are caused when 10% or less of bainite, as a second phase, is contained in addition to martensite in those amounts.

Average crystal grain size: 10 $\mu$m or less.

The present invention adopts a larger crystal grain size, calculated from a grain size based on a picture of a cross-sectional structure by a quadrature in accordance with ASTM, and a nominal grain size based on a picture of a cross-sectional structure by a cutting method in accordance with ASTM (for instance, see Umemoto et al.: Heat Treatment, 24 (1984), 334).

Although the cold rolled steel sheet of the present invention has a predetermined amount of solid solution N as a product, the present inventors' test results showed that strain age hardening characteristics fluctuate greatly even at a constant amount of solid solution N when the average crystal grain size of a ferritic phase exceeds 10 $\mu$m. The deterioration of mechanical characteristics also becomes obvious when the steel sheet is kept at room temperature. The detailed mechanism is currently unknown. However, it is assumed that one cause of inconsistent strain age hardening characteristics is crystal grain size, and that crystal grain size is related to the segregation and precipitation of alloy elements to a grain boundary, and furthermore, the effect of work and heat treatments thereon. Thus, in order to stabilize strain age hardening characteristics, a ferritic phase should have an average crystal grain size of 10 $\mu$m or less. It is also preferable that ferrite has an average crystal grain size of 8 $\mu$m or less in order to further increase a BH amount and $\Delta$TS with stability.

The cold rolled steel sheet of the present invention having the above-mentioned composition and structure has a tensile strength TS of 440 MPa or higher and excellent strain age hardening characteristics. The cold rolled steel sheet has excellent workability and impact resistance.

When TS is below 440 MPa, the steel sheet cannot be applied for structural members. Additionally, in order to broaden the applications, it is desirable that TS is 500 MPa or above.

"Having excellent strain age hardening characteristics" in the present invention indicates, as described above, that an increase in deformation stress before and after an aging treatment (referred to as BH amount; BH amount=yield stress after the aging treatment−predeformation stress before the aging treatment) is 80 MPa or higher under the aging condition of holding the temperature at 170° C. for 20 minutes after the predeformation at the tensile strain of 5%, and that an increase in tensile strength (referred to as $\Delta$TS; $\Delta$TS=tensile strength after the aging treatment−tensile strength before the predeformation) before and after a strain aging treatment (the predeformation+the aging treatment) is 40 MPa or higher.

A prestrain (predeformation) amount is an important factor regulating strain age hardening characteristics. The present inventors assumed deformation styles that are applicable to steel sheets for vehicles, and examined the effect of a prestrain amount on strain age hardening characteristics. As a result, they found that (1) deformation stress in the deformation styles can be regulated by a uniaxial equivalent strain (tensile strain) amount, except for the case of extremely deep drawing; (2) a uniaxial equivalent strain exceeds 5% in actual parts; and (3) part strength corresponds well to strength (YS and TS) obtained after a strain aging process at 5% of prestrain. Based on that knowledge, predeformation of a strain aging process is set at 5% of tensile strain.

Conventional coating and baking conditions are 170° C.×20 min. as a standard. When the strain of 5% or above is added to the steel sheet of the present invention containing a large amount of solid solution N, the steel sheet is hardened even by a milder treatment (at low temperature). In other words, aging conditions can be broader. Moreover, generally, in order to provide high hardenability, it is advantageous to hold a higher temperature for a longer period as long as the steel sheet is not softened by averaging.

Specifically, the lower limit of heating temperature at which hardening after predeformation becomes obvious, is 100° C. in the steel sheet of the present invention. On the other hand, hardening reaches the limit when the heating temperature exceeds 300° C. The steel sheet tends to be slightly soft on the contrary, and heat strain and temper color become noticeable at 400° C. Nearly enough hardening is performed if the heating temperature of about 200° C. is held for about 30 seconds. For more stable hardening, holding time is preferably 60 seconds or longer. However, if the holding time exceeds 20 minutes, hardening cannot be expected and productivity also sharply declines. Thus, this is impractical.

Based on the above, it was decided to evaluate aging conditions of the present invention in accordance with conventional coating and baking conditions, such as 170° C. of heating temperature and 20 minutes of holding time. Even under aging conditions of low temperature heating and short holding time under which conventional coating and baking steel sheets are not sufficiently hardened, the steel sheet of the present invention is well hardened with stability. Heating methods are not particularly limited. In addition to atmosphere heating by a furnace for general coating and baking purposes, for instance, inductive heating, and heating with a non-oxidizing flame, laser, plasma, and the like are all preferably used.

Vehicle parts have to be strong enough to resist complex external stress loads. Thus, material steel sheets have to have strength not only to resist small strains but also large strains. Based on this, the present inventors set a BH amount and ΔTS of the steel sheet of the present invention as a material for vehicle parts at 80 MPa or above and 40MPa or above. More preferably, a BH amount is 100 MPa or above, and ΔTS is 50 MPa or above. In order to further increase a BH amount and ΔTS, heating temperature may be set higher, and/or holding time may be made longer during aging.

The steel sheet of the present invention also has an advantage in that it can be stored for a long period, such as for about one year, at room temperature without aging deterioration (the phenomenon where YS increases and E1 (elongation) decreases) if it is not formed; this advantage is not conventionally found.

The present invention can still be effective even if a product sheet is relatively thick. However, when a product sheet exceeds the thickness of 3.2 mm, the cooling ratio will be sufficient enough during a rolled sheet annealing process. Strain aging is found during continuous annealing, and it will be difficult to achieve target strain age hardening characteristics as a product. Therefore, the thickness of the steel sheet of the present invention is preferably 3.2 mm or less.

Moreover, there are no problems in treating a surface of the cold rolled steel sheet of the present invention with electroplating or melt plating. These plated steel sheets also have about the same TS, BH amount and ΔTS as those before plating. Types of plating include electrogalvanizing, hot dip galvanizing, hot dip galvannealing, electrolytic tin plating, electrolytic chrome plating, electrolytic nickel plating, and the like. Any plating can be preferably applied.

Subsequently, the production of the steel sheet of the present invention will be explained.

The steel sheet of the present invention is produced by sequentially carrying out: a hot rolling step in which a sheet bar is prepared by roughly rolling a steel slab having a composition in the range mentioned above after heating, and the sheet bar is finish rolled and then cooled after finish rolling to provide a coiled hot rolled sheet; a cold rolling step in which the hot rolled sheet is treated with pickling and cold rolling; and a cold rolled sheet annealing step of continuously annealing the cold rolled sheet.

It is desirable to produce a slab for use in the production of the present invention by continuous casting so as to prevent the macro-level segregation of components. However, a slab may be produced by an ingot-making method and a thin slab continuous casting method. The production of the present invention is also applicable to energy-saving processes. Included are a normal process in which a slab is cooled to room temperature after production and is reheated, hot direct rolling after inserting a warm steel piece into a furnace without cooling, and direct rolling right after some heat insulation. Particularly, the direct rolling is useful as it delays the precipitation of N, thus effectively maintaining solid solution N.

First, the reasons for limiting hot rolling conditions will be explained.

Slab heating temperature: 1,000° C. or higher

The slab heating temperature is preferably 1,000° C. or higher in order to, as an initial state, maintain a necessary and sufficient amount of solid solution N and to obtain a target amount of solid solution N (0.0010% or more) as a product. As carbonitride becomes solution with acceleration at a more preferable temperature of 1,100° C. or higher, solid solution N is more likely to be maintained, which is also preferable in regards to uniform quality.

Moreover, in order to prevent an increase in loss due to an increase in oxidation, slab heating temperature is preferably 1280° C. or lower.

A slab heated under the above-mentioned conditions is made into a sheet bar by rough rolling. It is unnecessary to set the conditions of rough rolling in particular, and rough rolling may be carried out under general conventional conditions. However, it is desirable to keep the process as short as possible so as to maintain solid solution N.

Subsequently, the sheet bar is finish rolled, thus providing a hot rolled sheet.

Moreover, it is preferable in the present invention that adjacent sheet bars are joined between rough rolling and finish rolling, and that they are continuously finish rolled. It is preferable to join sheet bars by a pressure-welding method, a laser beam welding method, an electron beam welding method, and the like.

Thus, there are less unstable sections (tip section and end section of a material to be treated) where a form is likely to be distorted by finish rolling and cooling thereafter. Stable rolling length (successive rolling length under the same conditions), and stable cooling length (successive cooling length under stress) are extended, improving the shape, size precision and yield of products. Moreover, lubrication rolling to thin and wide sheet bars can be easily performed although the lubrication rolling has been difficult in single rolling for conventional sheet bars due to problems in sheet-passing, gripping, and the like. Rolls also last longer as rolling load and roll surface pressure decrease.

Moreover, it is preferable in the present invention to evenly distribute temperature in a width direction as well as a longitudinal direction of a sheet bar by using one or both of a sheet bar edge heater that heats a width edge section of the sheet bar, and a sheet bar heater that heats a length edge section of the sheet bar, between rough rolling and finish rolling. Thus, the quality of a steel sheet becomes more consistent. The sheet bar edge heater and the sheet bar heater are preferably induction heating types.

First, it is desirable to compensate a temperature difference in a width direction by a sheet bar edge heater. Heating also depends on a steel composition and the like at this time, but it is preferable to set temperature in a width direction at a finish rolling delivery-side at 20° C. or less. Subsequently, a temperature difference in a longitudinal direction is compensated for by a sheet bar heater. It is preferable to set the temperature of a length edge section higher than that of a center section by about 20 to 40° C. Draft of finish rolling final pass: 25% or above The final pass of finish rolling is one of the important factors for determining a microstructure of a steel sheet. Unrecrystallized austenite where enough strains are accumulated, can be transformed into ferrite by the draft of 25% or above. Accordingly, the structure of a hot rolled sheet becomes clearly fine. By using this as a material, a ferritic structure can be obtained having a final target average grain size of 10 μm or less by cold rolling and annealing. Moreover, the structure after cold rolling and annealing becomes not only fine but also consistent at the draft of 25% or above. In other words, the grain size distribution of a ferritic phase becomes consistent, and dispersed phases are also fine and uniform. Accordingly, there is also an advantage in that hole expanding properties also improve.

Finish rolling delivery-side temperature: 800° C. or higher.

Finish rolling-delivery-side temperature FDT is 800° C. or higher in order to provide an even and fine steel sheet structure. When FDT is below 800° C., the structure becomes uneven, and a working structure partially remains. The working structure can be prevented at high temperature. However, when coiling temperature is high, large crystal grains generate, and the amount of solid solution N decreases markedly. Thus, it becomes difficult to obtain the target tensile strength TS of 440 MPa or above. Additionally, in order to further improve mechanical characteristics, it is desirable to set FDT at 820° C. or higher. It is preferable to cool a steel sheet immediately after finish rolling so as to provide fine crystal grains and secure a solid solution amount.

Cooling after finish rolling: cooling within 0.5 seconds after finish rolling, and quenching at the cooling ratio of 40° C./s or higher.

It is desirable in the present invention that cooling is started immediately after (within 0.5 seconds) finish rolling, and that the average cooling ratio is 40° C./s or higher during cooling. Since these conditions are satisfied, the high temperature of AlN precipitation sharply decreases and solid solution N can be effectively maintained. When the above-mentioned conditions are not satisfied, grain growth progresses too much, and it will be difficult to provide fine crystal grains. Thus, it is more likely that AlN precipitation will progress too far due to strain energy introduced during rolling and a solid solution N amount will be insufficient. Moreover, in order to obtain even quality and shapes, the cooling ratio is preferably 300° C./s or below.

Coiling temperature: 750° C. or below.

As coiling temperature CT declines, the strength of a steel sheet tends to increase. In order to obtain the target tensile strength of 440 MPa or above, CT is preferably 750° C. or below, more preferably, 650° C. or below. Additionally, when CT is below 200° C., a steel sheet shape tends to be distorted, which results in trouble during operations and tends to make material quality uneven. Therefore, it is desirable that CT is 200° C. or above. For more even material quality, CT is preferably 300° C. or above. Moreover, ferrite+pearlite (cementite) are more preferable as a hot rolling sheet structure, so that it is more preferable that coiling temperature is 600° C. or above. This is because ferritic+pearlitic phases are more evenly cold rolled as the phases have a smaller difference in hardness between the two than the structure having martensite or bainite as a second phase.

Moreover, lubrication rolling may be performed in the present invention in order to reduce hot rolling load during finish rolling. The shape and quality of a hot rolled sheet become more even due to lubrication rolling. The coefficient of friction during lubrication rolling is preferably 0.25 to 0.10. Hot rolling becomes stable by combining lubrication rolling and continuous rolling.

After the above-mentioned hot rolling step, the hot rolled sheet is then pickled and cold rolled into a cold rolled sheet in a cold rolling step.

Pickling conditions can be normally conventional conditions, and are not particularly limited. When a hot rolled sheet is extremely thin, it may be cold rolled right away without pickling.

Moreover, cold rolling conditions can be normally conventional conditions, and are not particularly limited. It is also preferable that a cold draft is 40% higher in order to provide an even structure. Additionally, a cold rolled sheet is treated with continuous annealing in a cold rolled sheet annealing step.

Continuous annealing temperature: between recrystallization temperature and 900° C.

The annealing temperature of continuous annealing is the recrystallization temperature or above.

When the continuous annealing temperature is lower than the recrystallization temperature, recrystallization is not completed. Although target strength is achieved, ductility is low. As a result, formability declines, and the sheet is not applicable as steel sheets for vehicles. It is preferable to set continuous annealing temperature at 700° C. or above in order to further improve formability. On the other hand, when continuous annealing temperature exceeds 900° C., nitride such as AlN deposits, and the solid solution N amount of a steel sheet as a product becomes insufficient. Thus, it is preferable to set the continuous annealing temperature between the recrystallization temperature and 900° C. Particularly, when higher yield ratios are desirable, annealing temperature is preferably 850° C. or below so as to prevent a structure from enlarging and to reduce the loss of solid solution N due to the progress of precipitation.

In the sixth invention, annealing temperature is preferably between (Ac1 transformation point) and (Ac3 transformation point). Annealing is preferably continuous annealing for the sake of productivity. Heating is carried out at the temperature of ($Ac_1$ transformation point) to ($Ac_3$ transformation point) in an annealing step. Two phases of an austenitic (γ) phase and a ferritic (α) phase are formed by heating in this temperature range. C concentrates in the γ phase. The γ phase transforms into a martensitic phase during cooling, and a second phase is formed and a composite structure of α+martensite is thus formed. Accordingly, ductility and workability improve, and low yield ratios are obtained.

On the other hand, a ferrite+pearlitite structure is obtained below the Ac1 transformation point of annealing temperature. Beyond the $Ac_3$ transformation point, alloy elements do not concentrate enough in the γ phase. Thus, ductility slightly declines, and yield ratios slightly increase. However, strain age characteristics are kept high.

Holding time of continuous annealing temperature: 10 to 120 seconds.

It is preferable to keep the holding time of continuous annealing temperature as short as possible in order to provide a fine structure and keep a desirable amount of solid solution N or more. However, for operation stability, the holding time is preferably 10 seconds or longer. When the holding time exceeds 120 seconds, it will be difficult to provide a fine structure and maintain a solid solution N amount. Thus, the holding time of continuous annealing temperature is preferably 10 to 120 seconds. The holding time of continuous annealing temperature is more preferably 10 to 90 seconds, and most preferably, 10 to 60 seconds.

The cooling ratio in primary cooling is 10 to 300° C./s down to the temperature of 500° C. or below in the second invention. Cooling after soaking in continuous annealing is important to provide a fine structure and to maintain a solid solution N amount. Continuous cooling is carried out at the cooling ratio of 10 to 300° C./s down to the temperature of 500° C. or below as primary cooling in the present invention. If the cooling ratio is less than 10° C./s, it will be difficult to provide an even and fine structure and to secure solid solution N at a desirable amount or more. On the other hand, when the cooling ratio exceeds 300° C./s, material quality becomes inconsistent in a width direction of a steel sheet. When cooling stopping temperature is above 500° C. in case of cooling at the cooling ratio of 10 to 300° C./s, a fine structure cannot be obtained.

For secondary cooling, residence time in a temperature range of the cooling stopping temperature of the primary cooling or below and 400° C. or above is 300 seconds or below. The secondary cooling after the primary cooling becomes important for strain age hardening characteristics. The specific mechanism is currently unclear, but it is assumed that solid solution C and N amounts change by the conditions of the secondary cooling and affect strain age characteristics. It is preferable in the present invention that cooling is continued after the primary cooling, and cooling is carried out for the residence time of 300 seconds or below in the temperature range of the cooling stopping temperature of the primary cooling or below and 400° C. or above. The so-called averaging process may be performed after continuous annealing in the present invention, but strain age hardening characteristics decrease due to the overaging process. Thus, it is preferable in the present invention to carry out the overaging process at an extremely low temperature in an averaging zone when sheets are passed through the overaging zone of a continuous annealing furnace.

The cooling ratio in cooling (primary cooling) after holding at the annealing temperature is preferably 70° C./s down to 600° C. or below in the fourth invention. Cooling after soaking in continuous annealing is important to provide a fine structure and to secure a solid solution N amount. Continuous cooling is carried out at the cooling ratio of 70° C./s down to 600° C. or below in the present invention. If the cooling ratio exceeds 70° C./s, yield ratios will decline and material quality in the width direction of a steel sheet will be uneven. The cooling ratio is more preferably 5° C./s or above to secure TS and YS. When cooling stopping temperature is above 600° C. in case of cooling at such cooling ratio, hardenability declines, which is not preferable.

So-called averaging in which a predetermined temperature range is held, may or may not be particularly carried out after the primary cooling. However, for improving material quality, particularly, ductility, it is desirable to reduce solid solution C as much as possible to reduce cold age hardening and make more effective the strain age hardening characteristics on solid solution N. In order to achieve this, it is preferable to carry out an overaging process in which the temperature range of 350 to 450° C. is held for 120 seconds or less.

It is preferable in the sixth invention that heating to the soaking temperature of annealing is at the heating rate of 5° C./s or above at least between 600° C. and ($Ac_1$ transformation point). When the rate is below 5° C./s, it becomes troublesome to secure a solid solution N amount. The rate is more preferably 5 to 30° C./s.

Cooling after soaking: Average cooling ratio between 600° C. and 300° C. at a critical cooling rate CR or above.

Cooling after soaking in annealing is important to provide a fine structure, to secure a solid solution N amount and to form martensite. In the present invention, cooling is performed at an average cooling rate of 600 to 300° C., supposedly a critical cooling rate CR or above. The critical cooling rate CR is defined by the following formula (1) or (2) based on the amounts of alloy elements:

$$\text{when } B<0.0003\%,\ \log CR=-1.73[\text{Mn}+2.67\text{Mo}+1.3\text{Cr}+0.26\text{Si}+3.5\text{P}+0.05\text{Cu}+0.05\text{Ni}]+3.95 \quad (1);\ \text{and}$$

$$\text{when } B\geqq 0.0003\%,\ \log CR=-1.73[\text{Mn}+2.67\text{Mo}+1.3\text{Cr}+0.26\text{Si}+3.5\text{P}+0.05\text{Cu}+0.05\text{Ni}]+3.40 \quad (2)$$

wherein CR is a cooling rate (° C./s); and Mn, Mo, Cr, Si, P, Cu and Ni are the contents of each element (mass %). In the formulae (1) and (2), elements that are not contained are calculated as zero.

The precipitation of pearlite can be prevented during cooling, in accordance with the amounts of alloy elements, with at least the average cooling ratio which is the critical cooling rate CR of either Formula (1) or (2). When the cooling ratio is below CR (° C./s) defined by each formula mentioned above, it becomes difficult to form martensite M (sometimes partly containing bainite) as a second phase. A structure of a product sheet cannot be a composite structure composed of α+M (+B). When the average cooling ratio exceeds 300° C./s, material quality becomes uneven in a width direction of a steel sheet. Thus, for cooling after annealing, the average cooling ratio between 600 and 300° C. is CR that is defined by Formula (1) or (2), or above, or preferably, 300° C./s or below. It is also preferable that the average cooling ratio in the temperature range below 300° C. is 5° C./s.

Furthermore, temper rolling or leveling at the elongation percentage of 1.0 to 15% may be continuously carried out after the cold rolled sheet annealing step in the present invention. Due to temper rolling or leveling after the cold rolled sheet annealing step, strain age hardening characteristics, such as an BH amount and ΔTS, can improve with stability. The elongation percentage in temper rolling or leveling is preferably 1.0% or above in total. When the elongation percentage is below 1.0%, there is little improvement in strain age hardening characteristics. On the other hand, when the elongation percentage exceeds 15%, the ductility of a steel sheet decreases. Moreover, the present inventors confirmed that there is not much difference between temper rolling and leveling with respect to effects on strain age hardening characteristics, although their working styles differ.

EXAMPLE 1

Molten steel having compositions shown in Table 1 were prepared by a converter, and slabs were prepared by continuous casting. The slabs were heated under conditions shown in Table 2, preparing sheet bars having thickness shown in Table 2 by rough rolling and then preparing hot rolled sheets in a hot rolling step in which finish rolling was performed under conditions shown in Table 2. For a portion thereof, lubrication rolling was performed in the finish rolling.

Pickling and a cold rolling step consisting of cold rolling under conditions shown in Table 2 were carried out on the hot rolled sheets, thus preparing cold rolled sheets. Continuous annealing was performed on the cold rolled sheets under conditions shown in Table 2 in a continuous annealing furnace. For a portion thereof, temper rolling was continuously carried out after the cold rolled sheet annealing step. The annealing temperature in continuous annealing was the recrystallization temperature or above in any case.

Solid solution N amounts, microstructures, tensile characteristics, strain age hardening characteristics, fatigue resistance and impact resistance were tested for the cold rolled and annealed sheets obtained thereby.

(1) Solid Solution N Amounts

The amounts of solid solution N were calculated by subtracting a deposited N amount from a total N amount in steel found by chemical analysis. The deposited N amounts were found by the analysis applying the constant potential electrolysis mentioned above.

(2) Microstructures

Test pieces were collected from each cold rolled and annealed sheet, and the images of microstructure thereof were recorded by an optical microscope or a scanning electron microscope for cross sections (C cross sections) orthogonal to a rolling direction. The fractional ratios of ferrite as a main phase and the types of second phases were found by an image analyzing device. A larger crystal grain size was used as the crystal grain size of the main ferritic phase, chosen from a grain size calculated from a structural picture of a cross section (C cross section) orthogonal to a rolling direction by a quadrature in accordance with ASTM, and a nominal grain size calculated by a cutting method in accordance with ASTM.

(3) Tensile Characteristics

JIS No. 5 test pieces were collected in a rolling direction from each cold rolled and annealed sheet. A tensile test was carried out at the strain speed of $3\times10^{-3}$/s based on the provision of JIS Z 2241, and yield strength YS, tensile strength TS and elongation percentage El were found.

(4) Strain Age Hardening Characteristics

JIS No. 5 test pieces were collected in a rolling direction from each cold rolled and annealed sheet. Tensile prestrain of 5% was given as predeformation, and a heat treatment equivalent to a coating and baking treatment of 170° C.×20 minutes was also carried out. A tensile test was carried out at the strain speed of $3\times10^{-3}$/s, and tensile characteristics (yield stress $YS_{BH}$, tensile strength TS) after a predeformation-coating and baking process were found. Then, BH amounts=$YS_{BH}-YS_{5\%}$ and $\Delta TS=TS_{BH}-TS$ were calculated. $YS_{5\%}$ is transformation stress when product sheets are predeformed at 5%. $YS_{BH}$ and $TS_{BH}$ are yield stress and tensile stress after the predeformation-coating and baking process, respectively. TS is the tensile strength of product sheets.

(5) Fatigue Resistance

Fatigue test pieces were collected in a rolling direction from each cold rolled and annealed sheet, and a tensile fatigue test was carried out at the minimum stress of 0 MPa in accordance with the provision of JIS Z 2273. The fatigue limit ($10^7$ repetitions)$_{\sigma FL}$ was found. Tensile prestrain of 5% was added as predeformation, and a heat treatment equivalent to a coating and baking treatment of 170° C.×20 minutes was also carried out. The same fatigue test was carried out, and the fatigue limit ($_{\sigma FL}$)BH was found. An improvement in fatigue resistance (($_{\sigma FL}$) BH−$_{\sigma FL}$) due to a predeformation-coating and baking treatment was evaluated.

(6) Impact Resistance

Impact test pieces were collected in a rolling direction from each cold rolled and annealed sheet. A high-speed tensile test was carried out at the strain speed of $2\times10^3$/s in accordance with the high-speed tensile test described on page 1,058 of "Journal of the Society of Materials Science Japan, 10(1998)", and a stress-strain curve was found. Based on the stress-strain curve, absorbed energy E was calculated by integrating stress in the range of 0 to 30% of strain. Tensile prestrain of 5% was added as predeformation, and a heat treatment equivalent to a coating and baking treatment of 170° C.×20 minutes was also carried out. The same fatigue test was carried out thereafter, and absorbed energy $E_{BH}$ was found. An improvement in impact resistance $E_{BH}/E$ due to a predeformation-coating and baking treatment was evaluated.

Additionally, hot dip galvanizing was carried out on the surface of No. 11 and No. 13 steel sheets, and various characteristics were similarly evaluated.

All these results are shown in Table 3.

All the examples of the present invention have excellent ductility and strain age hardening characteristics, and have significantly high BH amounts and ΔTS. Improvements in fatigue resistance and impact resistance due to a strain aging treatment are large.

Moreover, the characteristics of the plated steel sheets where hot dip galvanizing was carried out on the surface of No. 11 and No. 13 steel sheets showed nearly the same characteristics as those before plating. For the galvanizing treatment, the steel sheets were dipped in a hot dip galvanizing bath, and coating weights were adjusted by gas wiping after lifting the dipped steel sheets. The galvanizing conditions were a sheet temperature of 475° C., galvanizing bath of 0.13% Al—Zn, bath temperature of 475° C., dipping time of three seconds, and coating weight of 45 g/m$^2$.

EXAMPLE 2

Steel having compositions shown in Table 4 were used to prepare slabs in the same method of Example 1. The slabs were heated under conditions shown in Table 5, preparing sheet bars having the thickness of 25 mm by rough rolling and then preparing hot rolled sheets in a hot rolling step where finish rolling was performed under conditions shown in Table 5. Morever, adjacent sheet bars were joined by a pressure-welding method at an inlet of finish rolling after rough rolling, and the bars were continuously rolled. An induction heating type sheet bar edge heater and sheet bar heater were used to control the temperature of the width edge section and the length edge section of the sheet bars.

Pickling and a cold rolling step consisting of cold rolling under conditions shown in Table 5 were carried out on the hot rolled sheets, thus preparing cold rolled sheets having the thickness of 1.6 mm. Continuous annealing was performed on the cold rolled sheets under conditions shown in Table 5 in a continuous annealing furnace. The annealing temperature in continuous annealing was the recrystallization temperature or above in any case.

As in Example 1, (1) solid solution N amounts, (2) microstructures, (3) tensile characteristics, (4) strain age hardening characteristics, (5) fatigue resistance, and (6) impact resistance were tested for the cold rolled and annealed sheets obtained thereby.

The results are shown in Table 6.

All the examples of the present invention have excellent strain age hardening characteristics, and have significantly high BH amounts and ΔTS even with changes in production conditions. Improvements in fatigue resistance and impact resistance due to a strain aging treatment are also large. Moreover, the precision of sheet thickness and shapes of product steel sheets improved due to continuous rolling and the adjustment of temperature in the longitudinal direction and the width direction of sheet bars in the examples of the present invention. For steel sheet No. 1 as an example of the present invention and steel sheet No. 5 as a comparative example, aging conditions were changed, and strain age hardening characteristics were examined. The results are shown in Table 7. The test methods were the same as those in Example 1, and only aging temperature and aging time were changed.

The steel sheet No. 1 as an example of the present invention showed the BH amount of 115 MPa and ΔTS of 60 MPa by the aging treatment of 170° C.×20 minutes as standard aging conditions. Even under the wide range of aging conditions as shown in Table 7, the steel sheet No. 1 could satisfy the condition of BH amount of 80 MPa or above and ΔTS of 40 MPa or above. On the other hand, the comparative example did not show BH amounts and ΔTS as high as those in the example of the present invention even if the aging temperature was changed to the range of 100 to 300° C.

In other words, the steel sheet of the present invention can secure a high BH amount and ΔTS in a wide range of aging conditions.

EXAMPLE 3

Molten steel having compositions shown in Table 8 were prepared by a converter, and slabs were prepared by continuous casting. The slabs were heated under conditions shown in Table 9, preparing sheet bars having thickness shown in Table 9 by rough rolling and then preparing hot rolled sheets in a hot rolling step in which finish rolling was performed under conditions shown in Table 9. For a portion thereof, lubrication rolling was performed in the finish rolling.

Pickling and a cold rolling step consisting of cold rolling under conditions shown in Table 9 were carried out to the hot rolled sheets, thus preparing cold rolled sheets. Continuous annealing was performed on the cold rolled sheets under conditions shown in Table 9 in a continuous annealing furnace. Temper rolling was continuously carried out after the cold rolled sheet annealing step. The annealing temperature in continuous annealing was the recrystallization temperature or above in any case.

As in Example 1, (1) solid solution N amounts, (2) microstructures, (3) tensile characteristics, and (4) strain age hardening characteristics were tested for the cold rolled and annealed sheets obtained thereby. The results are shown in Table 10.

Moreover, the characteristics of plated steel sheets where hot dip galvanizing was carried out on the surface of steel No. 7 (steel sheet No. 9) were similarly evaluated. For the galvanizing treatment, the steel sheet was dipped in a hot dip galvanizing bath, and a coating weight was adjusted by gas wiping after lifting the dipped steel sheet. The galvanizing conditions were a sheet temperature of 475° C., galvanizing bath of 0.13% Al—Zn, bath temperature of 475C, dipping time of three seconds, and coating weight of 45 g/m$^2$. The annealing conditions for a continuous plating line were the same as those for a continuous annealing line.

All the examples of the present invention had excellent ductility, high yield ratios, and excellent strain age hardening characteristics, and had significantly high BH amounts and ΔTS.

Moreover, the tensile characteristics of the plated steel sheet where hot dip galvanizing was carried out on the surface of the steel No. 7 (steel sheet No. 9) showed nearly the same characteristics as those before plating in consideration of a balance between strength and elongation, although TS tends to decrease slightly.

EXAMPLE 4

Steel having compositions shown in Table 11 were used to prepare slabs in the same method of Example 3. The slabs were heated under conditions shown in Table 12, preparing sheet bars having the thickness of 25 mm by rough rolling and then preparing hot rolled sheets in a hot rolling step where finish rolling was performed under conditions shown in Table 12. Moreover, adjacent sheet bars were joined by a pressure-welding method at an inlet of finish rolling after rough rolling, and were continuously rolled. An induction heating type sheet bar edge heater and a sheet bar heater were used to control the temperature in the width edge section and the length edge section of the sheet bars, respectively.

Pickling and a cold rolling step consisting of cold rolling under conditions shown in Table 12 were carried out on the hot rolled sheets, thus preparing cold rolled sheets having the thickness of 1.2 to 1.4 mm. Continuous annealing was performed on the cold rolled sheets under conditions shown in Table 12 in a continuous annealing furnace. The annealing temperature in continuous annealing was the recrystallization temperature or above in any case.

As in Example 1, (1) solid solution N amounts, (2) microstructures, (3) tensile characteristics, and (4) strain age hardening characteristics were tested for the cold rolled and annealed sheets obtained thereby.

The results are shown in Table 13.

All the examples of the present invention had excellent ductility, high yield ratios, and excellent strain age hardening characteristics, and had significantly high BH amounts and ΔTS with stability, even with changes in production conditions. Moreover, the precision of sheet thickness and shapes of steel sheets products improved due to continuous rolling and the adjustment of temperature in the longitudinal direction and the width direction of sheet bars in the examples of the present invention.

For steel sheet No. 1 as an example of the present invention and steel sheet No. 10 as a comparative example, aging conditions were changed, and strain age hardening characteristics were examined. The results are shown in Table 14. The test methods were the same as those in Example 3, and only aging temperature and aging time were changed.

The example of the present invention (steel sheet No. 1) showed the BH amount of 90 MPa and ΔTS of 50 MPa by the aging treatment of 170° C.×20 minutes as standard aging conditions. Even under the wide range of aging conditions as shown in Table 14, the steel sheet No. 1 could satisfy the condition of BH amount of 80 MPa or above and ΔTS of 40 MPa or above. On the other hand, the comparative example (steel sheet No. 10) did not show BH amounts and ΔTS as high as those in the example of the present invention even if aging temperature was changed to the range of 100 to 300° C.

In other words, the steel sheet of the present invention can secure a high BH amount and ΔTS over a wide range of aging conditions.

EXAMPLE 5

Molten steel having compositions shown in Table 15 were prepared by a converter, and slabs were prepared by continuous casting. The slabs were heated under conditions shown in Table 16, preparing sheet bars having thickness shown in Table 16 by rough rolling and then preparing hot rolled sheets in a hot rolling step in which finish rolling was performed under conditions shown in Table 16. For a portion thereof (steel sheets No. 2, No. 3), lubrication rolling was performed in the finish rolling. For the portion, adjacent sheet bars were also joined by a pressure-welding method at an inlet of finish rolling after rough rolling, and were continuously rolled. An induction heating type sheet bar edge heater and sheet bar heater were used to control the temperature of the width edge section and the length edge section of the sheet bars, respectively.

Pickling and a cold rolling step consisting of cold rolling under conditions shown in Table 16 were carried out on the hot rolled sheets, thus preparing cold rolled sheets. Annealing (continuous annealing) was performed on the cold rolled sheets under conditions shown in Table 16 in a continuous annealing furnace. After annealing, a cold rolled sheet annealing step was further carried out for cooling under the conditions shown in Table 16. For the portion, temper rolling was continuously performed after the cold rolled sheet annealing step. As in Example 1, (1) solid solution N amounts, (2) microstructures, (3) tensile characteristics, (4) strain age hardening characteristics, and (5) impact resistance were tested for the cold rolled and annealed sheets. Furthermore, (6) formability was also tested.

(6) Formability

As an indicator for formability, r values were found.

JIS No. 13B test pieces were collected from each cold rolled and annealed sheet from a rolling direction (direction L), 45° direction (direction D) relative to the rolling direction, and 90° direction (direction C) relative to the rolling direction. The width strain and the thickness strain of each test piece were found when a uniaxial tensile prestrain of 15% was added to the test pieces. Based on the ratios between the width strain and the thickness strain, r values in each direction were found:

$$r=\ln(w/w_0)/\ln(t/t_0)$$

wherein $w_0$ and $t_0$ are the width and the thickness of test pieces before the test, respectively; and w and t are the width and the thickness of the test pieces after the test, respectively. Based on the following formula, the average r values, $r_{mean}$, were calculated:

$$r_{mean}=(rL+2rD+rc)/4.$$

Herein, $r_L$ is a r value in the rolling direction (direction L); $r_D$ is a r value in 45° direction (direction D) relative to the rolling direction (direction L); and $r_C$ is a r value in 90° direction (direction C) relative to the rolling direction (direction L).

These results are shown in Table 17.

All the examples of the present invention show excellent ductility and low yield ratios, and furthermore, have excellent strain age hardening characteristics. BH amounts and ΔTS are significantly high, and improvements in impact resistance due to strain aging are also large.

Industrial Applicability

The present invention can produce high tensile strength cold rolled steel sheets having yield stress of 80 MPa or above and tensile strength of 40 MPa or above due to a predeformation-coating and baking treatment, and that also have increasing high strain age hardening characteristics and high formability therewith, economically and without distorting shapes, providing remarkable industrial effects. Furthermore, when the high tensile strength cold rolled steel sheet of the present invention is used for vehicle parts, there are effects such as yield stress as well as tensile strength will increase due to a coating and baking treatment, and the like, providing stable and good characteristics of parts, reducing the thickness of a steel sheet, for instance, from 2.0 mm to 1.6 mm, and reducing weights of vehicle bodies.

TABLE 1

| Steel | Chemical Components (mass %) | | | | | | | | | |
|---|---|---|---|---|---|---|---|---|---|---|
| No. | C | Si | Mn | P | S | Al | N | N/Al | Others | Mn/Si |
| A | 0.08 | 0.30 | 1.80 | 0.008 | 0.003 | 0.010 | 0.0090 | 0.90 | — | 6.0 |
| B | 0.05 | 0.50 | 1.70 | 0.005 | 0.005 | 0.011 | 0.0101 | 0.92 | — | 3.4 |
| C | 0.08 | 1.00 | 1.50 | 0.003 | 0.005 | 0.021 | 0.0120 | 0.57 | — | 1.5 |
| D | 0.03 | 0.55 | 1.70 | 0.005 | 0.003 | 0.007 | 0.0095 | 1.36 | Mo: 0.05 | 3.1 |
| E | 0.05 | 0.52 | 1.72 | 0.020 | 0.009 | 0.013 | 0.0130 | 1.00 | Ca: 0.0020 | 3.3 |
| F | 0.06 | 0.27 | 1.60 | 0.009 | 0.012 | 0.009 | 0.0099 | 1.10 | Ti: 0.015 | 5.9 |
| G | 0.07 | 0.05 | 1.70 | 0.007 | 0.009 | 0.008 | 0.0075 | 0.94 | Nb: 0.005, B: 0.0015 | 34.0 |
| H | 0.11 | 0.20 | 0.95 | 0.005 | 0.009 | 0.011 | 0.0110 | 1.00 | Ni: 0.07, REM: 0.0020 | 4.8 |
| I | 0.08 | 0.15 | 2.15 | 0.007 | 0.009 | 0.014 | 0.0115 | 0.82 | Cu: 0.1, Ni: 0.2 | 14.3 |
| J | 0.08 | 0.15 | 1.55 | 0.005 | 0.007 | 0.035 | 0.0025 | 0.07 | — | 10.3 |

TABLE 2

| Steel | | Hot rolling | | | | | | | |
|---|---|---|---|---|---|---|---|---|---|
| | | | Rough rolling | | Finish rolling | | | | |
| Steel sheet No. | Steel No. | Heating temperature of slab (SRT° C.) | Thickness of sheet bar (mm) | Sheet bar, jointed or unjointed | Delivery-side temperature (FDT° C.) | Thickness of hot rolled sheet (mm) | Cooling after rolling: Starting time (Δts) | Cooling after rolling: Cooling ratio (V° C./s) | Coiling: Coiling temperature (CT° C.) |
| 1 | A | 1200 | 30 | jointed | 850 | 2.6* | 0.4 | 50 | 540 |
| 2 | | 1180 | 28 | unjointed | 860 | 3.0 | 0.4 | 45 | 520 |
| 3 | | 1210 | 25 | unjointed | 840 | 2.6 | 0.3 | 50 | 500 |
| 4 | B | 1200 | 30 | unjointed | 900 | 3.2 | 0.3 | 50 | 600 |
| 5 | | 1250 | 40 | unjointed | 920 | 2.4 | 0.3 | 45 | 790 |
| 6 | C | 1200 | 30 | unjointed | 850 | 2.6 | 0.3 | 50 | 450 |
| 7 | D | 1200 | 35 | unjointed | 870 | 2.6 | 0.4 | 50 | 500 |

TABLE 2-continued

| | | | | | | | | | |
|---|---|---|---|---|---|---|---|---|---|
| 8 | E | 1190 | 30 | unjointed | 860 | 2.6 | 0.3 | 50 | 480 |
| 9 | F | 1200 | 30 | unjointed | 860 | 2.6 | 0.3 | 50 | 430 |
| 10 | | 1260 | 25 | unjointed | 860 | 5.0 | 0.2 | 45 | 500 |
| 11 | G | 1190 | 30 | unjointed | 850 | 2.8 | 0.2 | 45 | 510 |
| 12 | | 1090 | 35 | unjointed | 900 | 2.8 | 0.2 | 45 | 520 |
| 13 | H | 1090 | 30 | unjointed | 880 | 2.4 | 0.3 | 70 | 520 |
| 14 | I | 1150 | 25 | unjointed | 880 | 2.4 | 0.3 | 70 | 520 |
| 15 | J | 1140 | 25 | unjointed | 870 | 2.8 | 0.3 | 70 | 520 |

| | | Cold rolling | | Cold rolled sheet annealing | | | | | | |
|---|---|---|---|---|---|---|---|---|---|---|
| | | | | Continuous annealing | | Primary cooling | | Secondary cooling | Temper rolling | |
| Steel sheet No. | Steel No. | Cold draft (%) | Thickness of cold rolled sheet (mm) | Annealing temperature (° C.) | Holding time (s) | Cooling ratio (° C./s) | Cooling stopping temperature (° C.) | Residence time at 400° C. or above **(s) | Elongation percentage (%) | Remarks |
| 1 | A | 65 | 0.9 | 700 | 40 | 30 | 450 | 50 | 1.5 | Example of the present invention |
| 2 | | 67 | 1.0 | 770 | 40 | 35 | 300 | 0 | 1.5 | Example of the present invention |
| 3 | | 54 | 1.2 | 800 | 30 | 30 | 500 | 30 | — | Example of the present invention |
| 4 | B | 50 | 1.6 | 700 | 30 | 30 | 450 | 50 | 1.2 | Example of the present invention |
| 5 | | 58 | 1.0 | 720 | 30 | 45 | 300 | 0 | 1.2 | Comparative example |
| 6 | C | 69 | 0.8 | 770 | 40 | 50 | 400 | 0 | 1.5 | Example of the present invention |
| 7 | D | 42 | 1.5 | 800 | 20 | 28 | 300 | 0 | 1.5 | Example of the present invention |
| 8 | E | 46 | 1.4 | 720 | 30 | 35 | 300 | 0 | — | Example of the present invention |
| 9 | F | 46 | 1.4 | 770 | 20 | 35 | 500 | 30 | — | Example of the present invention |
| 10 | | 80 | 1.0 | 840 | 20 | 70 | 250 | 0 | — | Example of the present invention |
| 11 | G | 50 | 1.4 | 800 | 30 | 35 | 470 | 40 | 1.5 | Example of the present invention |
| 12 | | 43 | 1.6 | 770 | 50 | 30 | 500 | 40 | 5.0 | Example of the present invention |
| 13 | H | 71 | 0.7 | 730 | 40 | 80 | 500 | 120 | 10 | Example of the present invention |
| 14 | I | 67 | 0.8 | 750 | 40 | 70 | 500 | 90 | 1.5 | Example of the present invention |
| 15 | J | 43 | 1.6 | 750 | 30 | 30 | 500 | 90 | 1.5 | Comparative example |

*Performing lubrication rolling
**Cooling stopping temperature of primary cooling or below, and 400° C. or above

TABLE 3

| | | | Composition of steel sheet | | | Characteristics of product sheet | | | |
|---|---|---|---|---|---|---|---|---|---|
| | | Solid solution N | Ferrite | | | Tensile characteristics | | | |
| Steel sheet No. | Steel No. | amount of steel sheet (weight %) | Area ratio (%) | Grain size ($\mu$m) | Second phase Kind | YS MPa | TS MPa | El (%) | r value |
| 1 | A | 0.0085 | 90 | 7 | P | 387 | 480 | 35 | 1.1 |
| 2 | | 0.0088 | 93 | 6 | M | 320 | 520 | 35 | 1.0 |
| 3 | | 0.0088 | 85 | 7 | B | 345 | 490 | 33 | 1.1 |
| 4 | B | 0.0078 | 95 | 6 | P | 380 | 480 | 34 | 1.1 |
| 5 | | 0 | 96 | 11 | P, M | 375 | 540 | 32 | 1.2 |
| 6 | C | 0.0075 | 85 | 7 | B | 435 | 620 | 29 | 1.1 |
| 7 | D | 0.0065 | 84 | 5 | M | 290 | 500 | 35 | 1.0 |
| 8 | E | 0.0101 | 90 | 7 | P, B | 410 | 530 | 33 | 1.1 |
| 9 | F | 0.0088 | 94 | 6 | B | 360 | 480 | 36 | 1.1 |
| 10 | | 0.0080 | 90 | 7 | B, M | 380 | 510 | 34 | 1.2 |
| 11 | G | 0.0065 | 95 | 5 | B | 385 | 510 | 33 | 1.0 |
| 12 | | 0.0060 | 97 | 5 | B | 420 | 545 | 30 | 1.0 |
| 13 | H | 0.0090 | 87 | 6 | P | 395 | 490 | 34 | 1.0 |
| 14 | I | 0.0095 | 85 | 6 | P | 520 | 651 | 29 | 1.0 |
| 15 | J | 0.0005 | 93 | 8 | P | 320 | 415 | 37 | 1.0 |

| Steel | | Characteristics after predeformation-coating and baking process | | Strain age hardening characteristics | | | | |
|---|---|---|---|---|---|---|---|---|
| | | | | BH | | Fatigue | Impact | |
| Sheet No. | Steel No. | YS MPa | TS MPa | amount MPa | ΔTS MPa | resistance $(\sigma_{FL})_{BH} - \sigma_{FL}$ | resistance $E_{BH}/E$ | Remarks |
| 1 | A | 525 | 540 | 115 | 60 | 80 | 1.15 | Example of the present invention |
| 2 | | 570 | 580 | 128 | 60 | 95 | 1.19 | Example of the present invention |
| 3 | | 530 | 548 | 122 | 58 | 85 | 1.15 | Example of the present invention |
| 4 | B | 515 | 534 | 106 | 54 | 75 | 1.12 | Example of the present invention |

TABLE 3-continued

| | | | | | | | | |
|---|---|---|---|---|---|---|---|---|
| 5 | | 480 | 545 | 35 | 5 | 0 | 0.99 | Comparative example |
| 6 | C | 642 | 675 | 102 | 55 | 81 | 1.15 | Example of the present invention |
| 7 | D | 525 | 550 | 89 | 50 | 71 | 1.10 | Example of the present invention |
| 8 | E | 570 | 599 | 135 | 69 | 109 | 1.21 | Example of the present invention |
| 9 | F | 520 | 545 | 125 | 65 | 95 | 1.18 | Example of the present invention |
| 10 | | 600 | 580 | 125 | 70 | 85 | 1.20 | Example of the present invention |
| 11 | G | 540 | 555 | 89 | 45 | 65 | 1.11 | Example of the present invention |
| 12 | | 535 | 590 | 85 | 45 | 63 | 1.15 | Example of the present invention |
| 13 | H | 500 | 552 | 123 | 62 | 97 | 1.11 | Example of the present invention |
| 14 | I | 701 | 716 | 128 | 65 | 101 | 1.21 | Example of the present invention |
| 15 | J | 390 | 425 | 30 | 10 | 0 | 0.95 | Comparative example |

M: Martensite,
B: Bainite,
P: Pearlite

TABLE 4

| | Chemical Components (mass %) | | | | | | | | |
|---|---|---|---|---|---|---|---|---|---|
| Steel No. | C | Si | Mn | P | S | Al | N | N/Al | Mn/Si |
| K | 0.07 | 0.31 | 1.75 | 0.010 | 0.005 | 0.011 | 0.0075 | 0.68 | 5.6 |

TABLE 5

| | | Hot rolling | | | | | | | |
|---|---|---|---|---|---|---|---|---|---|
| | | Rough rolling | | | Finish rolling | | | | Coiling |
| Steel sheet No. | Steel No. | Heating temperature of slab (SRT° C.) | Thickness of sheet bar (mm) | Sheet bar, jointed or unjointed | Delivery-side temperature (FDT° C.) | Thickness of hot rolled sheet (mm) | Cooling after rolling: Starting time (Δts) | Cooling after rolling: Cooling ratio (V° C./s) | Coiling temperature (CT° C.) |
| 2-1 | K | 1200 | 25 | jointed* | 880 | 2.9 | 0.4 | 70 | 520 |
| 2-2 | | 1210 | 28 | jointed* | 900 | 2.9 | 3.0 | 30 | 760 |
| 2-3 | | 1250 | 25 | jointed* | 910 | 3.2 | 0.4 | 50 | 520 |

| | | Cold rolling | | Cold rolled sheet annealing: Continuous annealing | | Cold rolled sheet annealing: Primary cooling | | Cold rolled sheet annealing: Secondary cooling | |
|---|---|---|---|---|---|---|---|---|---|
| Steel sheet No. | Steel No. | Cold draft (%) | Thickness of cold rolled sheet (mm) | Annealing temperature (° C.) | Holding time (s) | Cooling ratio (° C./s) | Cooling stopping temperature (° C.) | Residence time at 400° C. or above **(s) | Temper rolling Elongation percentage (%) |
| 2-1 | K | 45 | 1.6 | 780 | 20 | 30 | 450 | 40 | 1.0 |
| 2-2 | | 45 | 1.6 | 800 | 20 | 30 | 450 | 90 | 1.0 |
| 2-3 | | 50 | 1.6 | 810 | 30 | 40 | 450 | 40 | 1.0 |

*Use of sheet bar heater, edge heater
**Cooling stopping temperature of primary cooling or below, and 400° C. or above

TABLE 6

| | | Composition of steel sheet | | | | Characteristics of product sheet: Tensile characteristics | | | |
|---|---|---|---|---|---|---|---|---|---|
| | | Solid solution N | Ferrite | | | | | | |
| Steel sheet No. | Steel No. | amount of steel sheet (weight %) | Area ratio (%) | Grain size (μm) | Second phase Kind | YS MPa | TS MPa | El (%) | r value |
| 2-1 | K | 0.0070 | 95 | 7 | P, B | 380 | 475 | 36 | 1.0 |
| 2-2 | | 0.0008 | 96 | 12 | P | 360 | 450 | 36 | 1.0 |
| 2-3 | | 0.0068 | 95 | 7 | P,B | 385 | 480 | 36 | 1.1 |

TABLE 6-continued

| Steel sheet No. | Steel No. | Characteristics after predeformation-coating and baking process YS MPa | TS MPa | Strain age hardening characteristics BH amount MPa | ΔTS MPa | Fatigue resistance $(\sigma_{FL})_{BH} - \sigma_{FL}$ | Impact resistance $E_{BH}/E$ | Remarks |
|---|---|---|---|---|---|---|---|---|
| 2-1 | K | 508 | 520 | 85 | 45 | 55 | 1.11 | Example of the present invention |
| 2-2 | | 432 | 455 | 25 | 5 | 5 | 1.00 | Comparative example |
| 2-3 | | 510 | 525 | 90 | 45 | 53 | 1.10 | Example of the present invention |

M: Martensite,
B: Bainite,
P: Pearlite

TABLE 7

| Steel sheet No. | Strain age hardening characteristics | Aging 100° C. × 30 s | 100° C. × 20 min | 170° C. × 20 min | 200° C. × 10 min | 250° C. × 30 s | 300° C. × 20 min |
|---|---|---|---|---|---|---|---|
| 1 | BH amount (MPa) | 90 | 100 | 115 | 120 | 120 | 140 |
| | ΔTS (MPa) | 50 | 55 | 60 | 65 | 60 | 45 |
| 5 | BH amount (MPa) | 15 | 30 | 35 | 45 | 40 | 40 |
| | ΔTS (MPa) | 5 | 5 | 5 | 15 | 12 | 10 |

TABLE 8

| Steel No. | Chemical Components (mass %) C | Si | Mn | P | S | Al | N | Nb | Others | N/Al | Mn/Si |
|---|---|---|---|---|---|---|---|---|---|---|---|
| 1 | 0.08 | 0.05 | 1.80 | 0.01 | 0.003 | 0.010 | 0.0120 | 0.016 | — | 1.2 | 36 |
| 2 | 0.08 | 0.15 | 1.50 | 0.01 | 0.001 | 0.007 | 0.0095 | 0.012 | — | 1.4 | 10 |
| 3 | 0.05 | 0.20 | 1.80 | 0.01 | 0.002 | 0.010 | 0.0180 | 0.011 | Mo/0.10 | 1.8 | 9 |
| 4 | 0.08 | 0.05 | 2.00 | 0.01 | 0.001 | 0.008 | 0.0150 | 0.015 | Ti/0.010 | 1.9 | 40 |
| 5 | 0.08 | 0.25 | 1.80 | 0.01 | 0.001 | 0.008 | 0.0098 | 0.010 | V/0.08 Ca/0.0080 | 1.2 | 7 |
| 6 | 0.08 | 0.25 | 1.85 | 0.04 | 0.001 | 0.012 | 0.0155 | 0.025 | B/0.0010 | 1.3 | 7 |
| 7 | 0.08 | 0.01 | 1.70 | 0.02 | 0.001 | 0.010 | 0.0160 | 0.012 | Cu/0.15 Ni/0.10 | 1.6 | 170 |
| 8 | 0.08 | 0.01 | 1.75 | 0.01 | 0.001 | 0.065 | 0.0030 | 0.005 | — | 0.05 | 175 |
| 9 | 0.15 | 0.02 | 1.55 | 0.01 | 0.001 | 0.012 | 0.0150 | 0.010 | B/0.0015 REM/0.0090 | 1.3 | 78 |
| 10 | 0.05 | 0.01 | 1.20 | 0.01 | 0.003 | 0.010 | 0.0120 | 0.022 | — | 1.2 | 120 |

TABLE 9

| Steel sheet No. | Steel No. | Hot rolling: Heating temperature of slab (SRT° C.) | Rough rolling: Thickness of sheet bar (mm) | Sheet bar, jointed or unjointed | Finish rolling: Final pass draft (%) | Delivery-side temperature (FDT° C.) | Thickness of hot rolled sheet (mm) | Cooling after rolling: Starting time (Δts) | Cooling ratio (V° C./s) | Coiling: Coiling temperature (CT° C.) |
|---|---|---|---|---|---|---|---|---|---|---|
| 1 | 1 | 1200 | 35 | jointed | 28 | 880 | 3.2* | 0.2 | 50 | 540 |
| 2 | 1 | 1210 | 37 | unjointed | 28 | 870 | 3.2 | 0.3 | 50 | 540 |
| 3 | 1 | 1180 | 37 | jointed | 30 | 880 | 2.9 | 0.3 | 50 | 540 |
| 4 | 2 | 1190 | 37 | jointed | 28 | 850 | 4.0 | 0.3 | 50 | 540 |
| 5 | 3 | 1190 | 35 | jointed | 28 | 840 | 3.2 | 0.3 | 50 | 520 |
| 6 | 4 | 1200 | 35 | jointed | 30 | 850 | 3.2 | 0.2 | 55 | 520 |
| 7 | 5 | 1210 | 35 | jointed | 30 | 850 | 2.6 | 0.2 | 60 | 520 |
| 8 | 6 | 1210 | 40 | jointed | 28 | 880 | 2.6 | 0.2 | 45 | 520 |
| 9 | 7 | 1210 | 30 | jointed | 28 | 850 | 2.6 | 0.2 | 45 | 520 |
| 10 | 8 | 1210 | 30 | jointed | 32 | 850 | 2.6 | 0.2 | 45 | 480 |
| 11 | 9 | 1210 | 30 | jointed | 28 | 880 | 2.6 | 0.2 | 45 | 480 |
| 12 | 10 | 1200 | 38 | jointed | 28 | 890 | 2.6 | 0.2 | 45 | 480 |
| 13 | 1 | 1050 | 35 | jointed | 29 | 720 | 2.9 | 2.0 | 50 | 520 |
| 14 | 1 | 1190 | 35 | unjointed | 10 | 840 | 2.9 | 0.3 | 45 | 520 |
| 15 | 1 | 1200 | 35 | jointed | 29 | 880 | 2.9 | 0.3 | 45 | 720 |

TABLE 9-continued

| | | Cold rolling | | Cold rolled sheet annealing | | | | | Temper | |
|---|---|---|---|---|---|---|---|---|---|---|
| | | | Thickness | Continuous annealing | | Primary cooling | | Overaging | rolling | |
| Steel sheet No. | Steel No. | Cold draft (%) | of cold rolled sheet (mm) | Annealing temperature (° C.) | Holding time (s) | Cooling ratio (° C./s) | Cooling stopping temperature (° C.) | Holding time ** (s) | Elongation percentage (%) | Remarks |
| 1 | 1 | 68.8 | 1.0 | 770 | 20 | 45 | 390 | 40 | 1.2 | Example of the present invention |
| 2 | 1 | 62.5 | 1.2 | 800 | 30 | 45 | 390 | 40 | 1.5 | Example of the present invention |
| 3 | 1 | 72.4 | 0.8 | 840 | 20 | 45 | 390 | 40 | 1.0 | Example of the present invention |
| 4 | 2 | 70.0 | 1.2 | 820 | 30 | 45 | 390 | 20 | 1.5 | Example of the present invention |
| 5 | 3 | 56.3 | 1.4 | 820 | 30 | 50 | 400 | 60 | 1.5 | Example of the present invention |
| 6 | 4 | 62.5 | 1.2 | 820 | 30 | 50 | 400 | 60 | 1.5 | Example of the present invention |
| 7 | 5 | 53.8 | 1.2 | 820 | 30 | 50 | 400 | 60 | 1.5 | Example of the present invention |
| 8 | 6 | 61.5 | 1.0 | 800 | 35 | 35 | 420 | 40 | 1.2 | Example of the present invention |
| 9 | 7 | 61.5 | 1.0 | 800 | 35 | 35 | 400 | 40 | 1.2 | Example of the present invention |
| 10 | 8 | 61.5 | 1.0 | 800 | 35 | 35 | 350 | 40 | 1.2 | Comparative example |
| 11 | 9 | 53.8 | 1.2 | 800 | 35 | 45 | 360 | 90 | 1.5 | Example of the present invention |
| 12 | 10 | 53.8 | 1.2 | 790 | 25 | 50 | 350 | 100 | 1.2 | Example of the present invention |
| 13 | 1 | 72.4 | 0.8 | 800 | 25 | 45 | 400 | 45 | 1.2 | Comparative example |
| 14 | 1 | 72.4 | 0.8 | 920 | 20 | 20 | 400 | 40 | 1.2 | Comparative example |
| 15 | 1 | 72.4 | 0.8 | 800 | 25 | 45 | 490 | 10 | 1.0 | Comparative example |

*Performing lubrication rolling
**Residence time between 350° C. and 450° C.

TABLE 10

| | | Solid solution N | Solid | Composition of steel sheet | | | Characteristics of product | | | | Characteristics after pre-deformation- | | Strain age hardening | | |
|---|---|---|---|---|---|---|---|---|---|---|---|---|---|---|---|
| | | amount of | solution Nb | Ferrite | | | sheet | | | | coating and | | characteristics | | |
| Steel | | steel sheet | amount of | Area | Grain | Second | Tensile characteristics | | | | baking process | | BH | | |
| sheet No. | Steel No. | (weight %) | steel sheet (weight %) | ratio (%) | size (μm) | phase Kind | YS MPa | TS MPa | EI (%) | YR | YS MPa | TS MPa | amount MPa | ΔTS MPa | Remarks |
| 1 | 1 | 0.0095 | 0.009 | 92 | 5 | P | 481 | 585 | 30 | 0.82 | 601 | 635 | 90 | 50 | Example of the present invention |
| 2 | 1 | 0.0094 | 0.008 | 91 | 5 | P | 484 | 590 | 30 | 0.82 | 604 | 638 | 92 | 51 | Example of the present invention |
| 3 | 1 | 0.0098 | 0.009 | 90 | 4 | P | 500 | 615 | 28 | 0.81 | 621 | 665 | 85 | 50 | Example of the present invention |
| 4 | 2 | 0.0070 | 0.008 | 92 | 6 | P, B/1% | 447 | 545 | 32 | 0.82 | 560 | 595 | 85 | 50 | Example of the present invention |
| 5 | 3 | 0.0120 | 0.010 | 90 | 5 | P | 465 | 565 | 31 | 0.82 | 587 | 625 | 81 | 60 | Example of the present invention |
| 6 | 4 | 0.0110 | 0.011 | 88 | 3 | P, B/2% | 515 | 625 | 29 | 0.82 | 637 | 680 | 81 | 55 | Example of the present invention |
| 7 | 5 | 0.0080 | 0.008 | 92 | 4 | P | 490 | 595 | 29 | 0.82 | 610 | 640 | 82 | 45 | Example of the present invention |
| 8 | 6 | 0.0070 | 0.009 | 89 | 5 | P | 570 | 670 | 27 | 0.85 | 695 | 719 | 92 | 49 | Example of the present invention |
| 9 | 7 | 0.0080 | 0.010 | 92 | 5 | P | 457 | 557 | 31 | 0.82 | 578 | 607 | 95 | 50 | Example of the present invention |
| 10 | 8 | 0 | <0.001 | 93 | 12 | P | 420 | 520 | 31 | 0.81 | 470 | 540 | 25 | 20 | Comparative example |
| 11 | 9 | 0.0075 | 0.008 | 87 | 3 | P | 554 | 675 | 27 | 0.82 | 675 | 725 | 90 | 50 | Example of the present invention |
| 12 | 10 | 0.0085 | 0.010 | 95 | 6 | P | 388 | 457 | 38 | 0.85 | 512 | 507 | 95 | 50 | Example of the present invention |
| 13 | 1 | 0.0005 | 0.011 | 94 | 14 | P | 390 | 520 | 31 | 0.75 | 440 | 545 | 20 | 25 | Comparative example |

TABLE 10-continued

| Steel sheet No. | Steel No. | Solid solution N amount of steel sheet (weight %) | Solid solution Nb amount of steel sheet (weight %) | Composition of steel sheet: Ferrite Area ratio (%) | Ferrite Grain size (μm) | Second phase Kind | Characteristics of product sheet: Tensile characteristics YS MPa | TS MPa | EI (%) | YR | Characteristics after pre-deformation-coating and baking process YS MPa | TS MPa | Strain age hardening characteristics BH amount MPa | ΔTS MPa | Remarks |
|---|---|---|---|---|---|---|---|---|---|---|---|---|---|---|---|
| 14 | 1 | 0.0009 | 0.011 | 95 | 11 | P | 385 | 515 | 31 | 0.75 | 450 | 540 | 25 | 25 | Comparative example |
| 15 | 1 | 0.0009 | 0.011 | 94 | 15 | P | 370 | 500 | 32 | 0.74 | 470 | 520 | 25 | 20 | Comparative example |

P: Pearlite,
B: Bainite

TABLE 11

| Steel No. | Chemical Components (mass %) C | Si | Mn | P | S | Al | N | Nb | N/Al | Mn/Si |
|---|---|---|---|---|---|---|---|---|---|---|
| 11 | 0.051 | 0.005 | 0.85 | 0.02 | 0.005 | 0.015 | 0.0126 | 0.016 | 0.84 | 170 |

TABLE 12

| Steel sheet No. | Steel No. | Hot rolling: Heating temperature of slab (SRT° C.) | Rough rolling: Thickness of sheet bar (mm) | Sheet bar, jointed or unjointed | Finish rolling: Final pass draft (%) | Delivery-side temperature (FDT° C.) | Thickness of hot rolled sheet (mm) | Cooling after rolling: Starting time (Δts) | Cooling ratio (V° C./s) | Coiling: Coiling temperature (CT° C.) |
|---|---|---|---|---|---|---|---|---|---|---|
| 16 | 11 | 1190 | 38 | jointed* | 28 | 890 | 3.2 | 0.2 | 50 | 520 |
| 17 | 11 | 1200 | 38 | jointed* | 28 | 890 | 3.6 | 0.3 | 50 | 520 |
| 18 | 11 | 1200 | 38 | jointed* | 28 | 890 | 4.0 | 0.2 | 50 | 540 |

| Steel sheet No. | Steel No. | Cold rolling: Cold draft (%) | Thickness of cold rolled sheet (mm) | Cold rolled sheet annealing: Continuous annealing: Annealing temperature (° C.) | Holding time (s) | Primary cooling: Cooling ratio (° C./s) | Cooling stopping temperature (° C.) | Overaging: Heating time ** (s) | Temper rolling Elongation percentage (%) |
|---|---|---|---|---|---|---|---|---|---|
| 16 | 11 | 62.5 | 1.2 | 740 | 20 | 20 | 420 | 20 | 1.5 |
| 17 | 11 | 66.7 | 1.2 | 750 | 20 | 25 | 440 | 30 | 1.5 |
| 18 | 11 | 65.0 | 1.4 | 760 | 30 | 20 | 450 | 20 | 2.0 |

*Use of sheet bar heater, edge heater
**Residence time between 350° C. and 450° C.

TABLE 13

| Steel sheet No. | Steel No. | Solid solution N amount of steel sheet (weight %) | Solid solution Nb amount of steel sheet (weight %) | Composition of steel sheet: Ferrite Area ratio (%) | Ferrite Grain size (μm) | Second phase Kind | Characteristics of product sheet: Tensile characteristics YS MPa | TS MPa | EI (%) | YR | Characteristics after pre-deformation-coating and baking process YS MPa | TS MPa | Strain age hardening characteristics BH amount MPa | ΔTS MPa | Remarks |
|---|---|---|---|---|---|---|---|---|---|---|---|---|---|---|---|
| 16 | 11 | 0.0071 | 0.008 | 95 | 6 | P | 345 | 455 | 38 | 0.76 | 485 | 507 | 100 | 52 | Example of the present invention |
| 17 | 11 | 0.0075 | 0.008 | 95 | 5 | P | 349 | 460 | 38 | 0.76 | 490 | 510 | 95 | 50 | Example of the present invention |
| 18 | 11 | 0.0073 | 0.008 | 96 | 5 | P | 345 | 460 | 38 | 0.75 | 490 | 510 | 95 | 50 | Example of the present invention |

P: Pearlite,
B: Bainite

TABLE 14

| Steel sheet No. | Strain age hardening characteristics | Aging 100° C. × 30 s | 100° C. × 20 min | 170° C. × 20 min | 200° C. × 10 min | 250° C. × 30 s | 300° C. × 20 min |
|---|---|---|---|---|---|---|---|
| 1 | BH amount (MPa) | 40 | 80 | 90 | 95 | 90 | 85 |
| | ΔTS (MPa) | 20 | 45 | 50 | 55 | 50 | 45 |
| 10 | BH amount (MPa) | 5 | 10 | 25 | 27 | 27 | 20 |
| | ΔTS (MPa) | 0 | 5 | 20 | 20 | 15 | 10 |

TABLE 15

| Steel No. | Chemical Components (mass %) C | Si | Mn | P | S | Al | N | N/Al | Mo | Cr | Others | $Ac_1$ ° C. | $Ac_3$ ° C. |
|---|---|---|---|---|---|---|---|---|---|---|---|---|---|
| A | 0.032 | 0.01 | 1.70 | 0.010 | 0.004 | 0.010 | 0.0120 | 1.2 | 0.20 | 0.01 | — | 705 | 841 |
| B | 0.034 | 0.01 | 1.16 | 0.010 | 0.005 | 0.011 | 0.0150 | 1.4 | 0.15 | 0.98 | — | 727 | 844 |
| C | 0.050 | 0.05 | 1.20 | 0.011 | 0.005 | 0.015 | 0.0160 | 1.1 | 0.15 | 0.01 | — | 712 | 850 |
| D | 0.065 | 0.06 | 1.21 | 0.011 | 0.004 | 0.013 | 0.0175 | 1.3 | 0.01 | 0.52 | — | 721 | 832 |
| E | 0.082 | 0.35 | 1.69 | 0.008 | 0.005 | 0.011 | 0.0150 | 1.4 | 0.01 | 0.06 | Ni: 0.30, Cu: 0.50 | 711 | 812 |
| F | 0.030 | 0.56 | 1.72 | 0.005 | 0.003 | 0.014 | 0.0180 | 1.3 | 0.06 | 0.01 | Ca: 0.0020 | 721 | 860 |
| G | 0.060 | 0.29 | 1.62 | 0.005 | 0.012 | 0.009 | 0.0145 | 1.6 | 0.01 | 0.32 | Ti: 0.015 | 719 | 834 |
| H | 0.071 | 0.47 | 1.21 | 0.013 | 0.003 | 0.010 | 0.0145 | 1.5 | 0.01 | 0.96 | — | 740 | 844 |
| I | 0.069 | 0.02 | 2.00 | 0.012 | 0.003 | 0.010 | 0.0135 | 1.4 | 0.15 | 0.01 | — | 702 | 815 |
| J | 0.040 | 0.02 | 0.95 | 0.050 | 0.005 | 0.010 | 0.0145 | 1.5 | 0.01 | 0.30 | Nb: 0.015 | 718 | 894 |
| K | 0.034 | 0.01 | 1.16 | 0.010 | 0.005 | 0.011 | 0.0130 | 1.2 | 0.15 | 0.98 | Ni: 0.50, Cu: 1.0 | 719 | 816 |
| L | 0.035 | 0.01 | 1.21 | 0.010 | 0.002 | 0.011 | 0.0125 | 1.1 | 0.01 | 0.52 | B: 0.0010 | 719 | 843 |
| M | 0.060 | 0.01 | 0.65 | 0.010 | 0.002 | 0.011 | 0.0140 | 1.3 | 0.01 | 0.75 | REM: 0.002 | 721 | 851 |
| N | 0.061 | 0.01 | 1.30 | 0.010 | 0.004 | 0.012 | 0.0020 | 0.2 | 0.01 | 0.52 | — | 718 | 828 |

TABLE 16

| Steel sheet No. | Steel No. | Hot rolling: Rough rolling: Heating temperature of slab (SRT ° C.) | Thickness of sheet bar (mm) | Sheet bar, jointed or unjointed | Finish rolling: Delivery-side temperature (FDT ° C.) | Thickness of hot rolled sheet (mm) | Cooling after rolling: Starting time (Δts) | Cooling ratio (V ° C./s) | Coiling: Coiling temperature (CT ° C.) |
|---|---|---|---|---|---|---|---|---|---|
| 1 | A | 1200 | 30 | jointed* | 860 | 3.0 | 0.3 | 30 | 680 |
| 2 | B | 1200 | 32 | jointed* | 870 | 3.5 | 0.4 | 45 | 650 |
| 3 | C | 1210 | 32 | jointed* | 890 | 3.5 | 0.5 | 50 | 670 |
| 4 | D | 1230 | 35 | jointed* | 880 | 3.5 | 0.4 | 45 | 660 |
| 5 | E | 1200 | 28 | jointed | 860 | 2.5 | 0.5 | 50 | 550 |
| 6 | F | 1250 | 32 | unjointed | 890 | 3.5 | 0.5 | 50 | 680 |
| 7 | G | 1200 | 32 | unjointed | 860 | 3.5 | 0.4 | 55 | 550 |
| 8 | H | 1190 | 30 | unjointed | 860 | 3.0 | 0.5 | 50 | 550 |
| 9 | I | 1200 | 30 | unjointed | 840 | 3.0 | 0.5 | 50 | 500 |
| 10 | J | 1190 | 32 | unjointed | 840 | 2.5 | 0.5 | 55 | 600 |
| 11 | K | 1200 | 30 | unjointed | 850 | 3.0 | 0.5 | 40 | 580 |
| 12 | L | 1180 | 32 | unjointed | 860 | 2.5 | 0.5 | 45 | 680 |
| 13 | M | 1150 | 30 | unjointed | 870 | 2.5 | 0.4 | 55 | 550 |
| 14 | N | 1150 | 35 | jointed* | 880 | 3.5 | 0.4 | 45 | 660 |

| Steel sheet No. | Steel No. | Cold rolling: Cold draft (%) | Thickness of cold rolled sheet (mm) | Cold rolled sheet annealing: Continuous annealing: Heating speed** (° C./s) | Annealing temperature (° C.) | Holding time (s) | Cooling: Cooling ratio*** (° C./s) | Critical cooling rate (CR): Applied formula*** | CR**** (° C./s) | Temper rolling: Elongation percentage (%) |
|---|---|---|---|---|---|---|---|---|---|---|
| 1 | A | 67 | 1.0 | 12 | 800 | 40 | 32 | (1) | 1.0 | 0.8 |
| 2 | B | 65 | 1.2 | 10 | 800 | 40 | 25 | (1) | 0.1 | 1.0 |
| 3 | C | 65 | 1.2 | 8 | 810 | 40 | 30 | (1) | 11.7 | 0.9 |
| 4 | D | 55 | 1.6 | 6 | 815 | 45 | 25 | (1) | 3.5 | — |
| 5 | E | 67 | 0.8 | 15 | 790 | 50 | 28 | (1) | 3.7 | 1.0 |
| 6 | F | 55 | 1.6 | 6 | 810 | 40 | 25 | (1) | 2.5 | — |

TABLE 16-continued

| | | | | | | | | | | |
|---|---|---|---|---|---|---|---|---|---|---|
| 7 | G | 55 | 1.6 | 8 | 750 | 50 | 30 | (1) | 1.7 | 1.5 |
| 8 | H | 55 | 1.4 | 9 | 815 | 50 | 30 | (1) | 0.2 | 1.0 |
| 9 | I | 60 | 1.2 | 12 | 795 | 60 | 25 | (1) | 0.5 | 1.0 |
| 10 | J | 54 | 1.2 | 5 | 820 | 40 | 32 | (1) | 18.8 | 1.5 |
| 11 | K | 55 | 1.4 | 8 | 790 | 50 | 30 | (1) | 0.1 | — |
| 12 | L | 68 | 0.8 | 7 | 780 | 50 | 25 | (1) | 1.1 | 1.2 |
| 13 | M | 52 | 1.2 | 10 | 780 | 55 | 25 | (1) | 10.7 | 0.8 |
| 14 | N | 55 | 1.6 | 6 | 815 | 45 | 25 | (1) | 2.6 | 1.0 |

*Use of sheet bar heater, edge heater
**Heating temperature from 600° C. to $Ac_1$ transformation point
***Average cooling rate between 600° C. and 300° C.
****(1) logCR :: −1.73 [Mn + 2.67Mo + 1.3Cr + 0.26Si + 3.5P + 0.05(Cu + Ni)] + 3.95 B < 0.0003
(2) logCR :: −1.73 [Mn + 2.67Mo + 1.3Cr + 0.26Si + 3.5P + 0.05(Cu + Ni)] + 3.95 B ≦ 0.0003

TABLE 17

| | | | Composition of steel sheet | | | | | | | |
|---|---|---|---|---|---|---|---|---|---|---|
| | | Solid solution N | Ferrite | | Martensite | | Tensile characteristics | | | |
| Steel sheet No. | Steel No. | amount of steel sheet (weight %) | Area ratio (%) | (μm) | Area ratio (%) | Kind | YS MPa | TS MPa | EI (%) | YS (%) |
| 1 | A | 0.0062 | 95 | 8 | 5 | F + M | 300 | 550 | 35 | 55 |
| 2 | B | 0.0098 | 96 | 7 | 4 | F + M | 270 | 470 | 39 | 57 |
| 3 | C | 0.0088 | 95 | 7 | 5 | F + M | 265 | 460 | 40 | 58 |
| 4 | D | 0.0113 | 92 | 6 | 5 | F + M + B | 350 | 620 | 31 | 56 |
| 5 | E | 0.0098 | 94 | 7 | 6 | F + M | 350 | 560 | 35 | 63 |
| 6 | F | 0.0113 | 94 | 5 | 6 | F + M | 290 | 500 | 38 | 58 |
| 7 | G | 0.0053 | 93 | 6 | 7 | F + M | 300 | 510 | 35 | 59 |
| 8 | H | 0.0079 | 90 | 5 | 7 | F + M + B | 343 | 625 | 32 | 55 |
| 9 | I | 0.0089 | 95 | 5 | 5 | F + M | 370 | 655 | 28 | 56 |
| 10 | J | 0.0069 | 95 | 6 | 5 | F + M | 320 | 520 | 36 | 62 |
| 11 | K | 0.0078 | 94 | 7 | 6 | F + M | 300 | 555 | 36 | 54 |
| 12 | L | 0.0055 | 93 | 6 | 7 | F + M | 265 | 455 | 40 | 58 |
| 13 | M | 0.0088 | 92 | 5 | 8 | F + M | 290 | 550 | 34 | 53 |
| 14 | N | 0.0000 | 94 | 7 | 6 | F + M | 260 | 465 | 39 | 56 |

| | | | Characteristics after predeformation-coating and baking process | | Strain age hardening characterisitcs | | | |
|---|---|---|---|---|---|---|---|---|
| Steel sheet No. | Steel No. | Formability $r_{means}$ | YS MPa | TS MPa | BH amount MPa | ΔTS MPa | Impact resistance $E_{BH}/E$ | Remarks |
| 1 | A | 0.9 | 570 | 599 | 96 | 49 | 1.16 | Example of the present invention |
| 2 | B | 1.0 | 526 | 554 | 148 | 84 | 1.18 | Example of the present invention |
| 3 | C | 0.9 | 508 | 535 | 135 | 75 | 1.17 | Example of the present invention |
| 4 | D | 0.9 | 752 | 716 | 166 | 96 | 1.20 | Example of the present invention |
| 5 | E | 1.0 | 611 | 644 | 148 | 84 | 1.18 | Comparative example |
| 6 | F | 0.9 | 566 | 596 | 165 | 96 | 1.20 | Example of the present invention |
| 7 | G | 0.9 | 527 | 555 | 94 | 45 | 1.15 | Example of the present invention |
| 8 | H | 0.9 | 726 | 692 | 124 | 67 | 1.17 | Example of the present invention |
| 9 | I | 0.9 | 694 | 730 | 136 | 75 | 1.18 | Example of the present invention |
| 10 | J | 0.9 | 550 | 579 | 113 | 59 | 1.16 | Example of the present invention |
| 11 | K | 0.9 | 591 | 622 | 124 | 67 | 1.17 | Example of the present invention |
| 12 | L | 1.0 | 477 | 508 | 102 | 53 | 1.15 | Example of the present invention |
| 13 | M | 0.9 | 594 | 625 | 136 | 75 | 1.18 | Example of the present invention |
| 14 | N | 0. 9 | 408 | 480 | 30 | 15 | 0.97 | Example of the present invention |

M: Martensite,
B: Bainite,
P: Pearlite

What is claimed is:

1. A high yield ratio high tensile strength cold rolled steel sheet having excellent strain age hardening characteristics with tensile strength of 440 MPa or higher and a yield ratio of 0.7 or above, characterized in that the sheet has a composition containing, by mass %:

0.15% or less of C;

2.0% or less of Si;

3.0% or less of Mn;

0.08% or less of P;

0.02% or less of S;

0.02% or less of Al;

0.0050 to 0.0250% of N; and 0.007 to 0.04% of Nb;

having 0.3 or more of N/Al and 0.0010% or more of N in a solid solution state, and furthermore containing deposited Nb at 0.005% or more, and having the balance of Fe and inevitable impurities; and that the steel sheet has a structure containing a ferritic phase having an average crystal grain size of 10 $\mu$m or less at an area ratio of 50% or more, and mainly pearlite as a residual portion.

2. A high tensile strength cold rolled steel sheet, characterized in that the sheet further contains, in addition to the composition according to claim 1, one group, or two or more groups of the following a to d by mass %:

Group a: one, or two or more elements of Cu, Ni, Cr, and Mo at a total of 1.0% or less;

Group b: one or two elements of Ti and V at a total of 0.1% or less;

Group c: B at 0.0030% or less; and

Group d: one or two elements of Ca and REM at a total of 0.0010 to 0.010%.

3. A production of a high yield ratio high tensile strength cold rolled steel sheet having excellent strain age hardening characteristics with tensile strength of 440 MPa or more and a yield ratio of 0.7 or above, characterized in that sequentially carried out are:

a hot rolling step wherein a steel slab that has a composition containing, by mass %:

0.15% or less of C;

2.0% or less of Si;

3.0% or less of Mn;

0.08% or less of P;

0.02% or less of S;

0.02% or less of Al;

0.0050 to 0.0250% of N; and 0.007 to 0.04% of Nb;

and having N/Al of 0.3 or more is heated at a slab heating temperature of 1,100° C. or higher, and is roughly rolled to form a sheet bar, and the sheet bar is finish rolled at a final pass draft of 25% or more at a finish rolling delivery-side temperature of 800° C. or higher, and is coiled at a coiling temperature of 650° C. or below to form a hot rolled sheet;

a cold rolling step in which the hot rolled sheet is pickled and cold rolled to form a cold rolled sheet; and a cold rolled sheet annealing step in which the cold rolled sheet is annealed at a temperature between the recrystallization temperature and 900° C. for a holding time of 10 to 90 seconds, and the cold rolled sheet is cooled at a cooling rate of 70° C./s or below to a temperature of 600° C. and below.

* * * * *

UNITED STATES PATENT AND TRADEMARK OFFICE

CERTIFICATE OF CORRECTION

PATENT NO. : 6,899,771 B2
DATED : May 31, 2005
INVENTOR(S) : Kami et al.

It is certified that error appears in the above-identified patent and that said Letters Patent is hereby corrected as shown below:

Column 7,
Line 55, please change "Ac," to -- $Ac_1$ --,
Line 56, please change "$AC_3$" to -- $Ac_3$ --.

Signed and Sealed this

Twenty-second Day of November, 2005

JON W. DUDAS
*Director of the United States Patent and Trademark Office*